US007043907B2

(12) United States Patent
Asano et al.

(10) Patent No.: US 7,043,907 B2
(45) Date of Patent: May 16, 2006

(54) ELECTRO-HYDRAULIC ACTUATION SYSTEM

(75) Inventors: Youji Asano, Gifu (JP); Nobuaki Shimizu, Gifu (JP); Haruo Kodama, Gifu (JP)

(73) Assignee: Nabtesco Corporation, Tokyo (JP)

( * ) Notice: Subject to any disclaimer, the term of this patent is extended or adjusted under 35 U.S.C. 154(b) by 0 days.

(21) Appl. No.: 11/030,737

(22) Filed: Jan. 6, 2005

(65) Prior Publication Data

US 2005/0115234 A1 Jun. 2, 2005

Related U.S. Application Data

(63) Continuation of application No. PCT/JP03/008865, filed on Jul. 11, 2003.

(51) Int. Cl.
*F15B 9/10* (2006.01)

(52) U.S. Cl. ..... 60/452; 91/380

(58) Field of Classification Search ..... 60/422, 60/452; 91/380

See application file for complete search history.

(56) References Cited

U.S. PATENT DOCUMENTS 3,457,836 A * 7/1969 Henderson ..... 91/380
4,031,811 A * 6/1977 Inaba et al. ..... 91/380
4,901,627 A * 2/1990 Schulze ..... 91/380
6,334,308 B1 * 1/2002 Sato et al. ..... 60/452
6,438,952 B1 * 8/2002 Nozawa et al. ..... 60/452
6,439,101 B1 * 8/2002 Kodama et al. ..... 91/380
6,772,671 B1 * 8/2004 Asano et al. ..... 91/380

* cited by examiner

*Primary Examiner*—Edward K. Look
*Assistant Examiner*—Michael Leslie
(74) *Attorney, Agent, or Firm*—Akin Gump Strauss Hauer & Feld, LLP

(57) ABSTRACT

An electrohydraulic actuation system in which the quantity of fluid being fed to hydraulic actuators under higher load pressure among those of a plurality of electrohydraulic actuators can be prevented from becoming deficient. In the electrohydraulic actuation system (100), a selection valve (141), a two-position valve (142), a spring (143) and a hydraulic cylinder (144) for altering delivery alter delivery of the working oil of a variable delivery hydraulic pump (111) based on the maximum pressure of the working oil being fed to hydraulic motors (122, 132) and the delivery pressure of working pump (111), and pressure gauges (145, 146, 147, 148, 149) and a computer (not shown) alter the rotatim speeds of motors (123, 133) at a substantially same rate for them.

1 Claim, 21 Drawing Sheets

ELECTRO-HYDRAULIC ACTUATION SYSTEM

CROSS-REFERENCE TO RELATED APPLICATION

This application is a continuation of International Application No. PCT/JP03/008865, filed Jul. 11, 2003, which was published in the Japanese language on Jan. 22, 2004, under International Publication No. WO 2004/007973 A1, the disclosure of which is incorporated herein by reference.

BACKGROUND OF THE INVENTION

1.Technical Field

The present invention relates to an electro-hydraulic actuation system for use in a hydraulic shovel or asphalt finisher and more particularly to an electro-hydraulic actuation system to which a load sensing system (hereinafter, referred to as LS) is applied for changing the discharge volume of a pump based on the load pressure of an actuator so that a differential pressure between the load pressure of the actuator and the discharge pressure of the pump becomes substantially constant.

2. Background Art

Conventionally, as a hydraulic actuation system to which the LS is applied, there has been known, for example, a hydraulic actuation system 900 shown in FIG. 22.

The hydraulic actuation system 900 includes a variable displacement hydraulic pump 911 for discharging a working fluid, a tank 912 from which the working fluid is discharged and a relief valve 913 for keeping the working fluid discharge pressure of the variable displacement hydraulic pump 911 at a predetermined set pressure or lower.

In addition, the hydraulic actuation system 900 includes a unit 920 having reduction gears 921 connected to a load, not shown, a variable displacement hydraulic motor 922 for imparting a driving force to the reduction gears 921, an operation lever 923 adapted to be operated by an operator, a manual direction control valve 924 for changing the communication of the variable displacement hydraulic pump 911 and the tank 912 with the variable displacement hydraulic motor 922 in accordance with the operation amount of the operation lever 923 and an automatic two-position valve 925 for cutting off the communication of the variable displacement hydraulic pump 911 and the tank 912 with the variable displacement hydraulic motor 922 in accordance with the operation amount of the operation lever 923 when the communication of the variable displacement hydraulic pump 911 and the tank 912 with the variable displacement hydraulic motor 922 in accordance with the operation amount of the operation lever 923 is cut off by the manual direction control valve 924.

In addition, the hydraulic actuation system 900 includes a unit 930 having a similar configuration to that of the unit 920, while the detailed description of the unit 930 is omitted here.

Additionally, the hydraulic actuation system 900 includes a selector valve 941 for selecting a working fluid having a greater pressure of a working fluid supplied from the variable displacement hydraulic pump 911 to the variable displacement hydraulic motor 922 of the unit 920 and a working fluid supplied to the variable displacement hydraulic pump 911 to a variable displacement hydraulic motor 932 of the unit 930, a two-position electromagnetic valve 942 for allowing the working fluid discharged by the variable displacement hydraulic pump 911 to pass when a pressure resulting from adding a predetermined set pressure to the pressure of the working fluid selected by the selector valve 941 is greater than the working fluid discharge pressure of the variable displacement hydraulic pump 911 discharges the working fluid, a discharge volume changing hydraulic cylinder 943 for changing the discharge volume of the variable displacement hydraulic pump 911 based on the pressure of the working fluid which is allowed to pass by the two-position electromagnetic valve 942 and the working fluid discharge pressure of the variable displacement hydraulic pump 911.

By the configuration that has been described above, the discharge volume changing hydraulic cylinder 943 used to change the working fluid discharge volume of the variable displacement hydraulic pump 911 so that a difference between a larger pressure of the pressure of the working fluid supplied from the variable displacement hydraulic pump 911 to the variable displacement hydraulic motor 922 of the unit 920, that is, the load pressure of the unit 920 and the pressure of the working fluid supplied from the variable displacement hydraulic pump 911 to the variable displacement hydraulic motor 932 of the unit 930, that is, the load pressure of the unit 930 and the working fluid discharge pressure of the variable displacement hydraulic pump 911 becomes the set pressure of the two-position electromagnetic valve 942.

In the conventional hydraulic actuation system 900, however, there was a problem that the amount of the working fluid is short which is supplied to the variable displacement hydraulic motor having a larger load pressure of the variable displacement hydraulic motor 922 of the unit 920 and the variable displacement hydraulic motor 932 of the unit 930.

When the load pressure of the variable displacement hydraulic motor 922 of the unit 920 or the variable displacement hydraulic motor 932 of the unit 930 is increased, the working fluid discharge pressure of the variable displacement hydraulic pump 911 is increased due to the actions of the selector valve 941, the two-position electromagnetic valve 942 and the discharge volume changing hydraulic cylinder 943. However, in a case where the relationship between the working fluid discharge volume and discharge pressure of the variable displacement hydraulic pump 911 is such as shown in FIG. 23, namely, in a case where the variable displacement hydraulic pump 911 is a pump whose horse power is constant, the working fluid discharge volume of the variable displacement hydraulic pump 911 decreases as the working fluid discharge pressure thereof increases.

Here, when the working fluid discharge volume of the variable displacement hydraulic pump 911 becomes smaller than a total amount of working fluid needed to be supplied to the variable displacement hydraulic motor 922 of the unit 920 and the variable displacement hydraulic motor 932 of the unit 930, the working fluid discharged by the variable displacement hydraulic pump 911 flows to the variable displacement hydraulic motor having a smaller load pressure in preference to the other.

Then, there occurs a shortage in volume of the working fluid supplied to the variable displacement hydraulic motor having a larger load pressure of the variable displacement hydraulic motor 922 of the unit 920 and the variable displacement hydraulic motor 932 of the unit 930, and the output thereof is reduced when compared with a case where there occurs no shortage in volume of the working fluid supplied thereto.

Consequently, for example, in a case where the variable displacement hydraulic motor 922 of the unit 920 is used for driving a right side caterpillar of a hydraulic shovel and the variable displacement hydraulic motor 932 of the unit 930 is used for a left side caterpillar of the hydraulic shovel, when the operator attempts to move the hydraulic shovel straight forward by inputting substantially equal operation amounts to the operation lever 923 of the unit 920 and an operation lever 933 of the unit 930, in the event that a load borne by the right side caterpillar becomes larger than a load borne by the left side caterpillar as a result of, for example, the right side caterpillar riding on a stone or the left side caterpillar entering a puddle, the movement of the right side caterpillar becomes slower than the movement of the left side caterpillar, and the hydraulic shovel advances while turning to the right.

Then, an object of the invention is to provide an electro-hydraulic actuation system which can prevent the generation of a shortage in volume of a fluid supplied to a hydraulic actuator having a larger load pressure of hydraulic actuators of a plurality of electro-hydraulic actuators.

3. Disclosure of the Invention

With a view to solving the problem, according to the invention, there is provided an electro-hydraulic actuation system including a pump, a plurality of electro-hydraulic actuators each having an electric motor, a hydraulic actuator and a fluid volume changing valve for changing the volume of a fluid discharged by the pump based on driving amounts of the electric motor and the hydraulic actuator for supply to the hydraulic actuator, a discharge volume changing means for changing the volume of the fluid discharged by the pump based on a maximum pressure of pressures of the fluid supplied to the hydraulic actuators of the plurality of electro-hydraulic actuators and the discharge pressure of the fluid discharged by the pump and a rotational speed changing means for changing the rotational speed of the electric motors of the plurality of electro-hydraulic actuators at substantially the same ratio relative to the electric motors of the plurality of electro-hydraulic actuators based on a maximum pressure of pressures of the fluid supplied to the hydraulic actuators of the plurality of electro-hydraulic actuators and the discharge pressure of the fluid discharged by the pump.

By adopting this configuration, since the electro-hydraulic actuation system of the invention can reduce the volume of the fluid supplied to the hydraulic actuators of the plurality of electro-hydraulic actuators at substantially the same ratio when there occurs a shortage in volume of the fluid supplied to the hydraulic actuators of the plurality of electro-hydraulic actuators, it is possible to prevent the occurrence of a shortage in volume of the fluid supplied to the actuator having a larger load pressure of the hydraulic actuators of the plurality of electro-hydraulic actuators.

BEST MODE FOR CARRYING OUT THE INVENTION

Embodiments of the invention will be described below using the drawings.

(First Embodiment)

Firstly, the configuration of an electro-hydraulic actuation system according to a first embodiment will be described.

Figure 1:
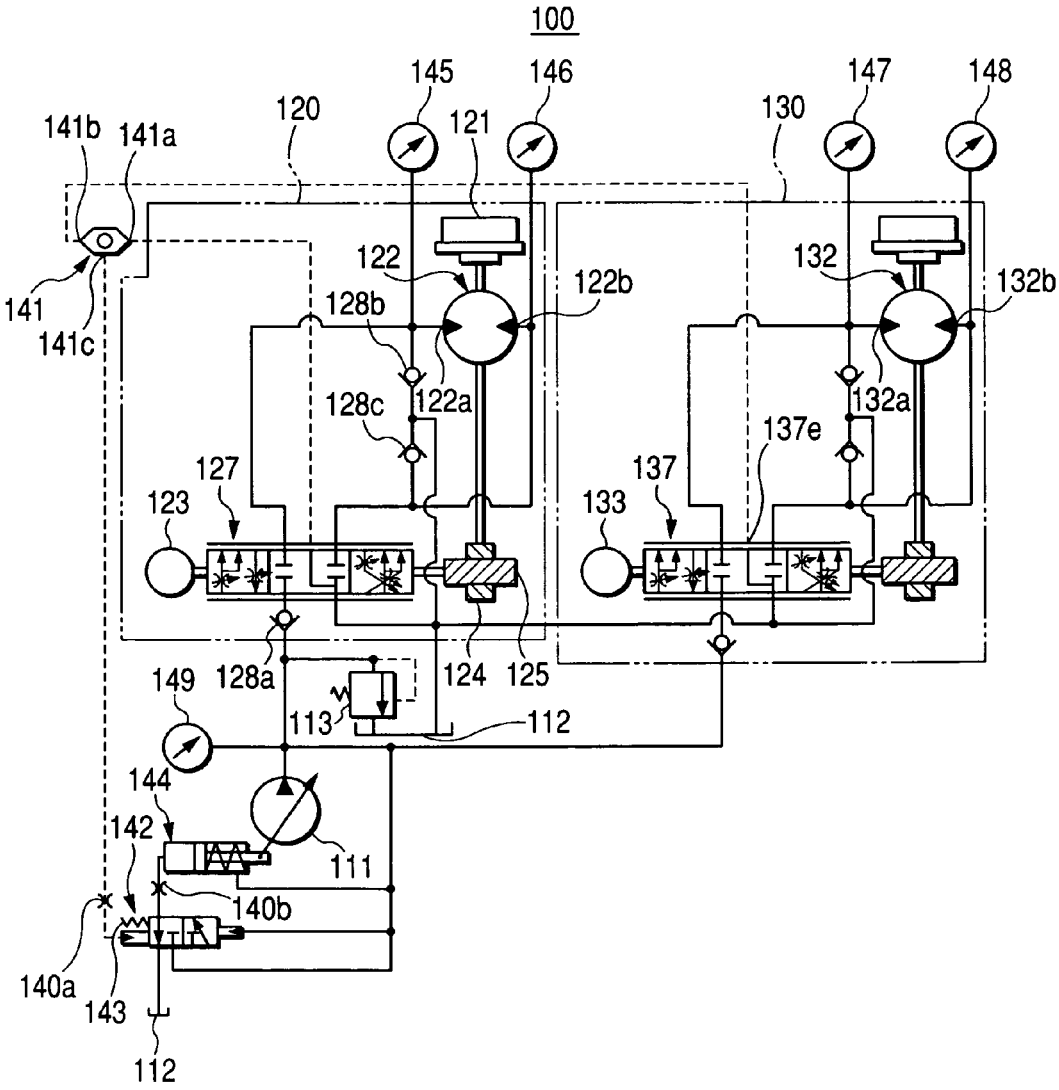
FIG. 1 is a hydraulic circuit diagram of an electro-hydraulic actuation system according to a first embodiment of the invention.
Figure 2:
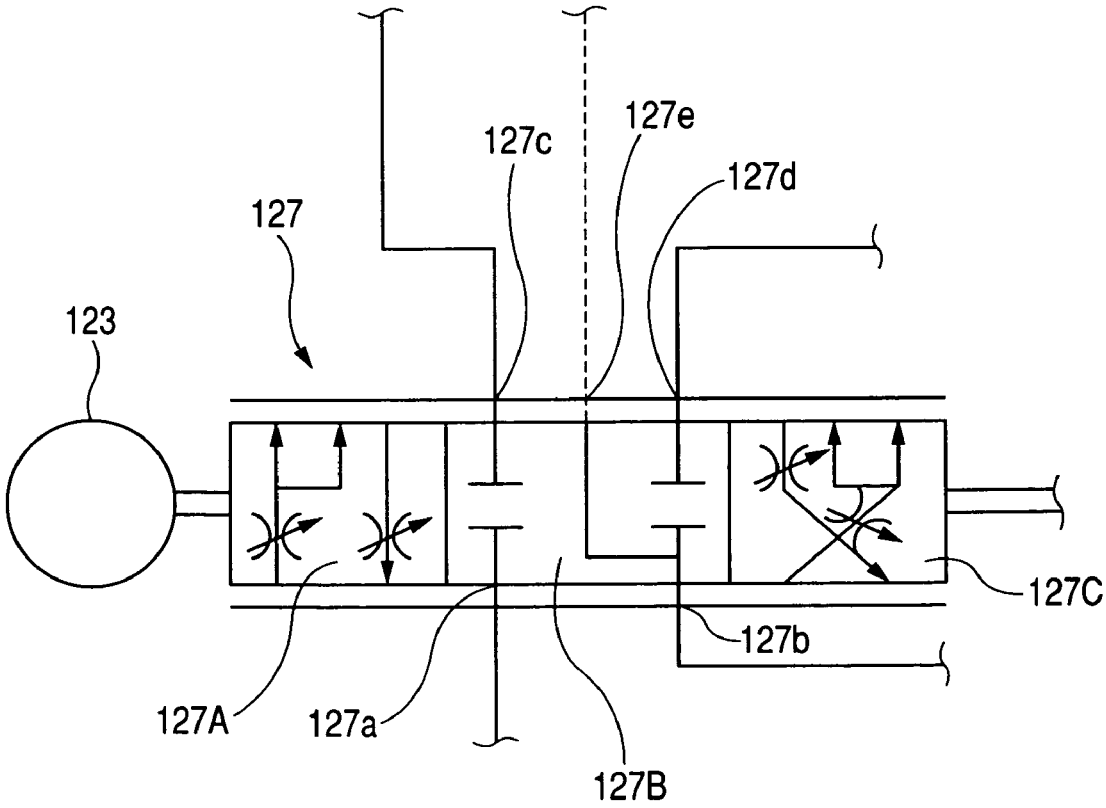
FIG. 2 is a hydraulic circuit diagram of the electro-hydraulic actuation system shown in FIG. 1 in the vicinity of an electro-hydraulic servo valve thereof.
Figure 3:
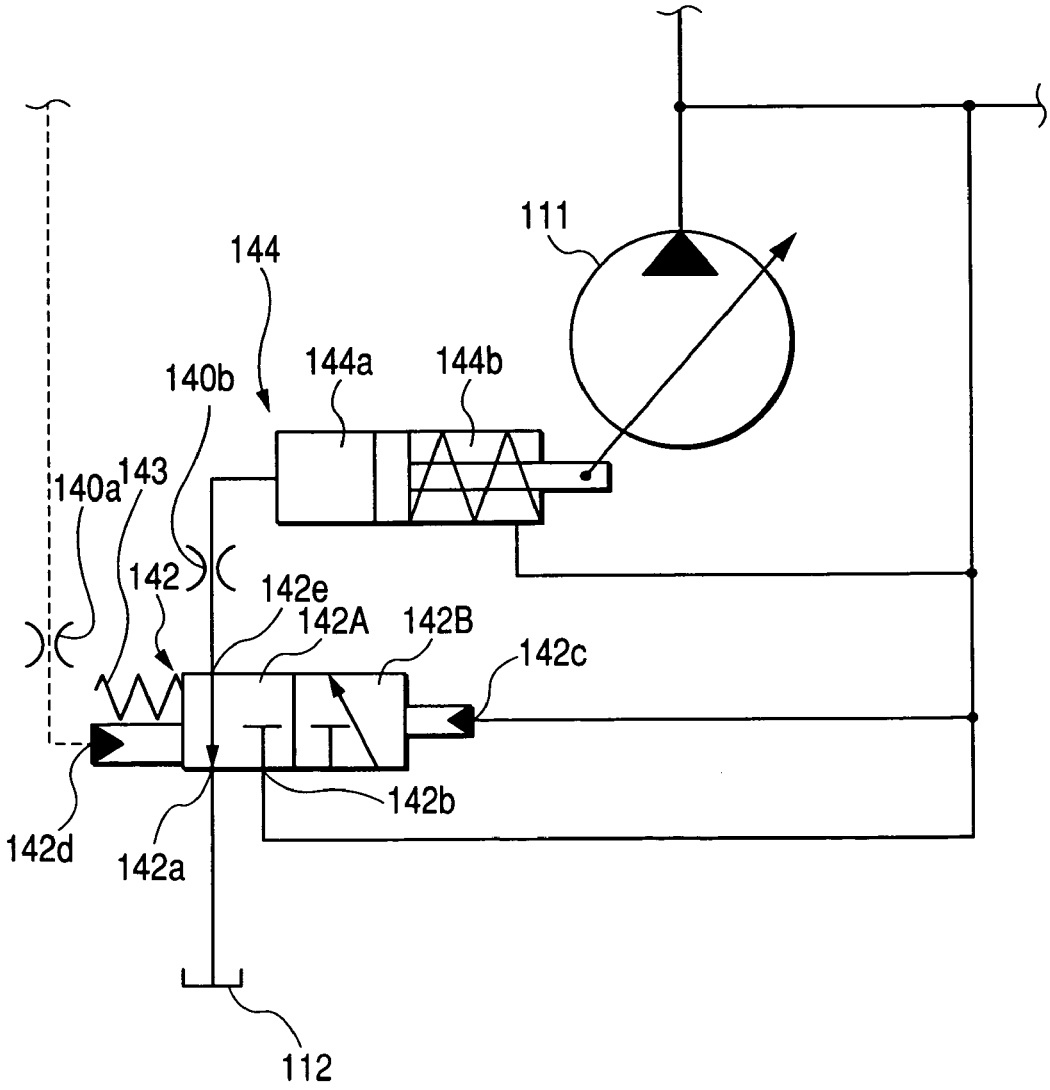
FIG. 3 is a hydraulic circuit diagram of the electro-hydraulic actuation system shown in FIG. 1 in the vicinity of a discharge volume changing hydraulic cylinder thereof.
Figure 4:
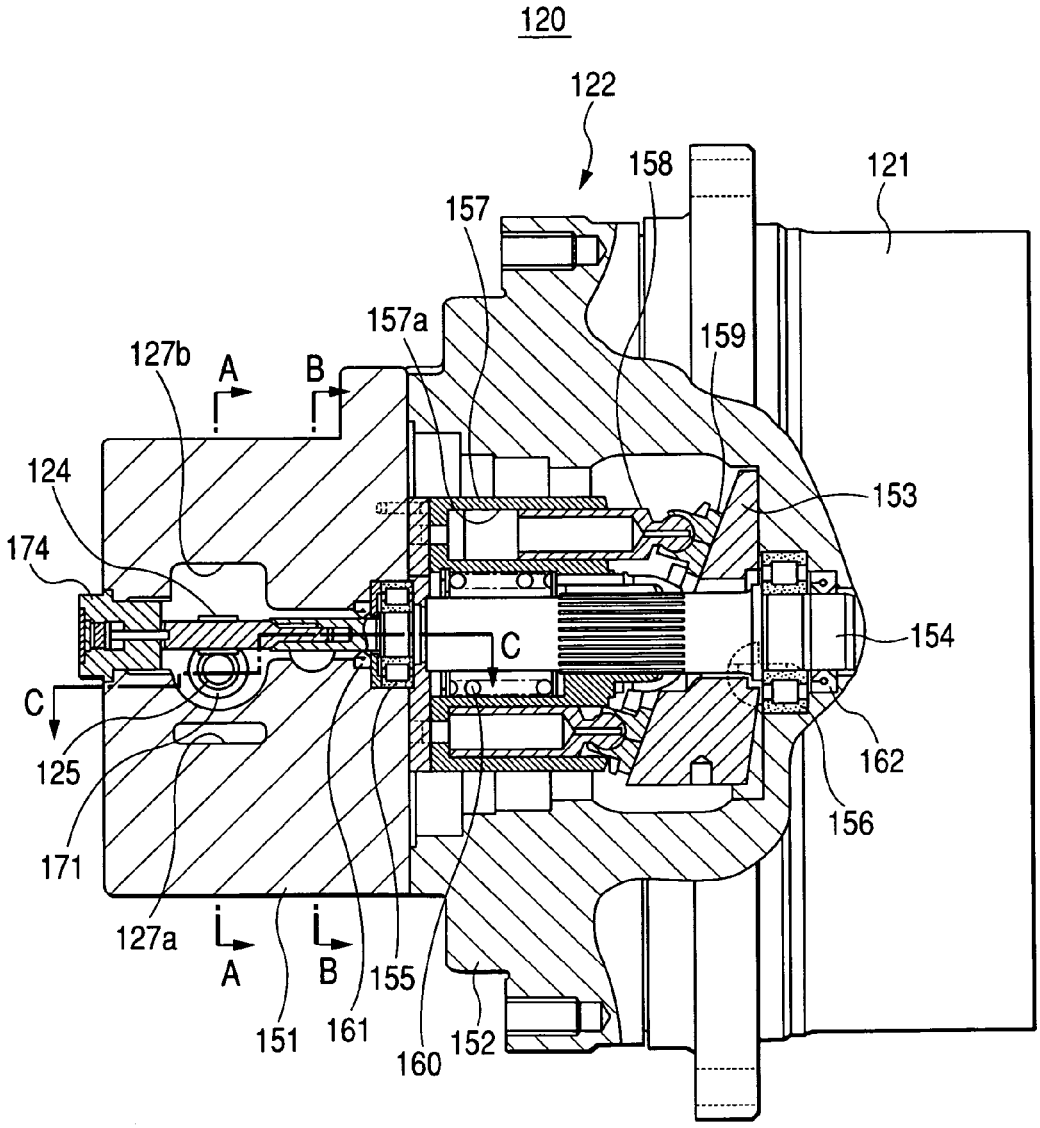
FIG. 4 is a sectional view of a unit of the electro-hydraulic actuation system shown in FIG. 1.
Figure 5:
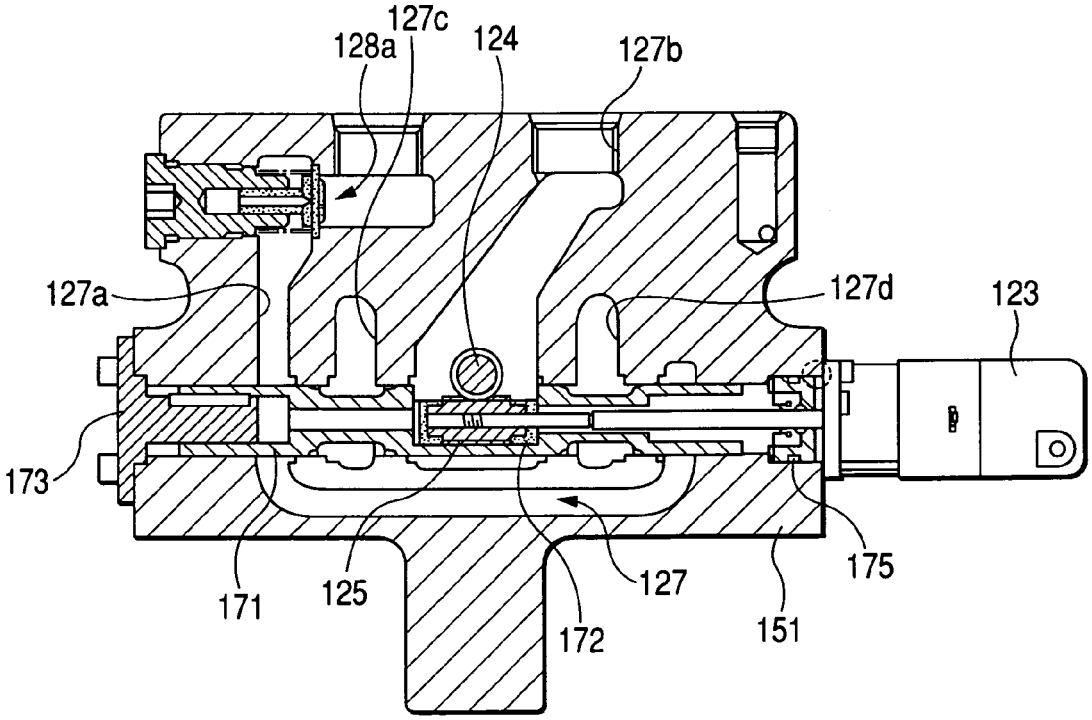
FIG. 5 is a sectional view taken along the line indicated by arrows A—A in FIG. 4 and viewed in a direction indicated by the arrows.
Figure 6:
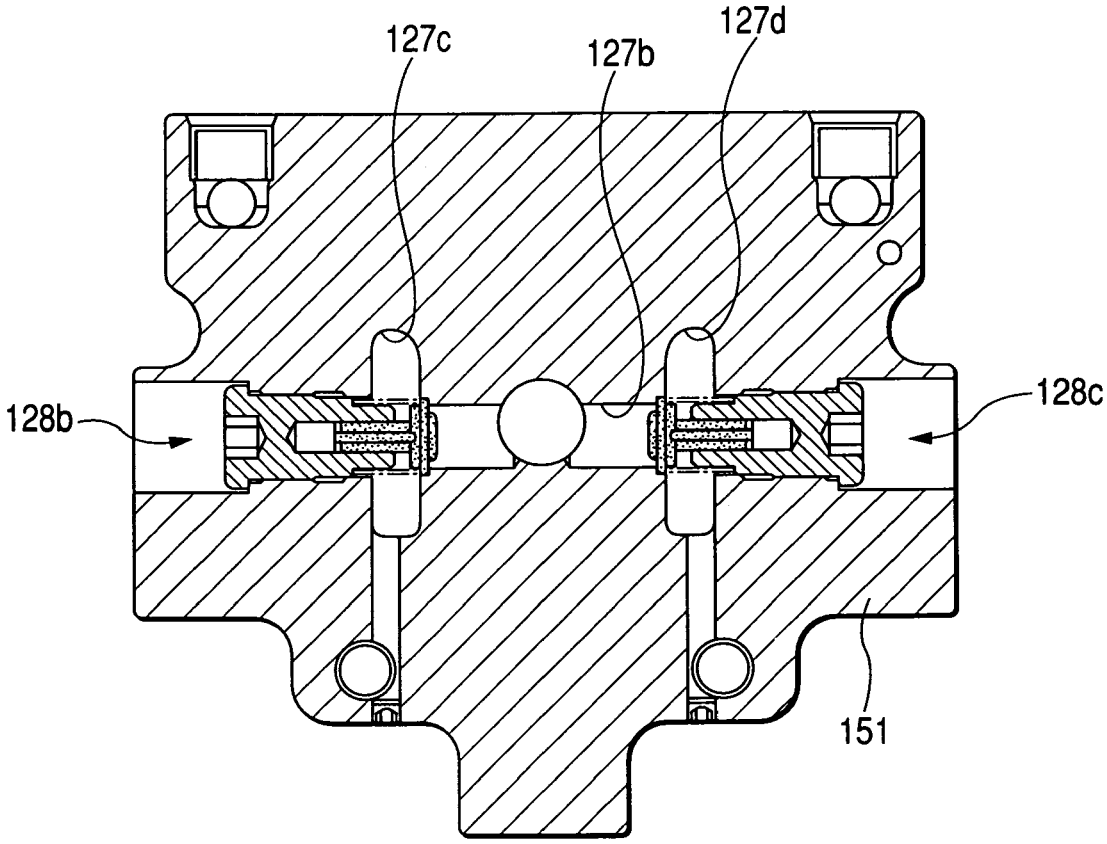
FIG. 6 is a sectional view taken along the line indicated by arrows B—B in FIG. 4 and viewed in a direction indicated by the arrows.
Figure 7:
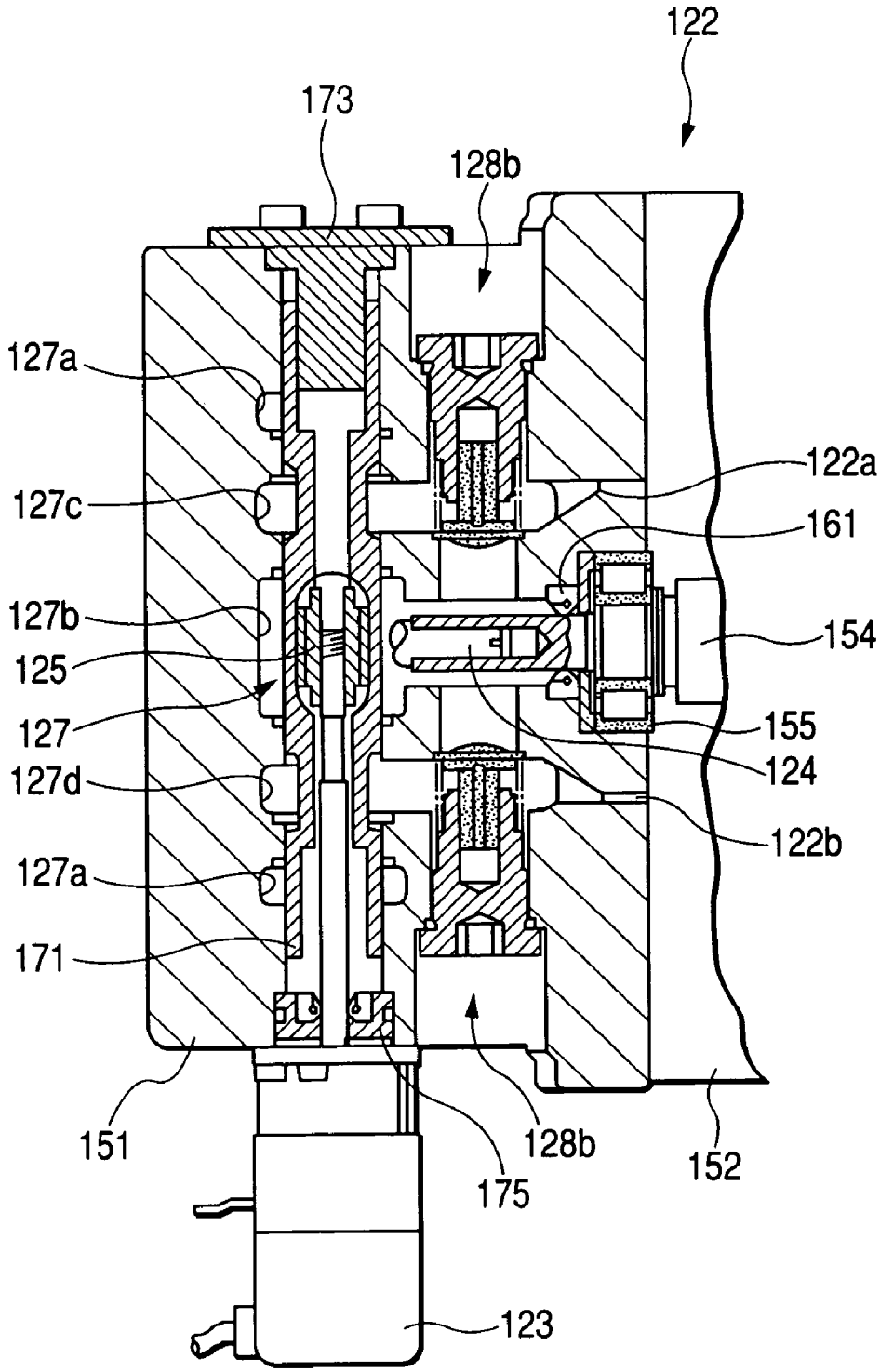
FIG. 7 is a sectional view taken along the line indicated by arrows C—C in FIG. 4 and viewed in a direction indicated by the arrows.

In FIGS. 1 to 3, an electro-hydraulic actuation system 100 as an electro-hydraulic actuation system according to the first embodiment includes a variable displacement hydraulic pump 111 as a pump of a constant horse power for discharging a working fluid (fluid), a tank 112 from which the working fluid is discharged and a relief valve 113 for keeping the working fluid discharge pressure of the variable displacement hydraulic pump 111 at a predetermined set pressure or lower.

In addition, the electro-hydraulic actuation system 100 includes a unit (refer to FIGS. 4 to 7) as an electro-hydraulic actuator having reduction gears 121 connected to a load not shown, a hydraulic motor 122 as a hydraulic actuator having formed therein a port 122*a* and a port 122*b* which are made to communicate with the variable displacement hydraulic pump 111 or the tank 112 and adapted to impart a driving force to the reduction gears 121 by virtue of the pressure of a working fluid supplied to the port 122*a* and the port 122*b*, an electric motor 123 driven in accordance with an electric signal entered, a first toothed shaft 124 adapted to rotate together with a driving shaft of the hydraulic motor 122 and a second toothed shaft 125 which is brought into a screw connection with a rotating shaft of the electric motor 123 and is brought into a mesh engagement with the first toothed shaft 124.

Here, the hydraulic motor 122 has, as shown in FIGS. 4 to 7, a box body 151 to which the electric motor 123 is fixed, a box body 152 fixed to the box body 151, a swash plate 153 fixed in the interior of the box body 152, a motor shaft 154 connected to the reduction gears 121 at one end and brought into engagement with the first toothed shaft 124 at the other end thereof in such a manner as to rotate in synchronism with the first toothed shaft 124, a bearing 155 and a bearing 156 which rotatably support the motor shaft 154 on the box body 151 and the box body 152, respectively, a cylinder block into which the motor shaft 154 is inserted at the center thereof, in which a plurality of cylinder chambers 157*a* are formed and which is in engagement with the motor shaft 154 in such a manner as to rotate in synchronism with the motor shaft 154, a plurality of pistons 158 accommodated in the cylinder chambers 157*a* in the cylinder block 157, shoe members 159 mounted on distal ends of the pistons 158, a spring 160 for biasing the cylinder block 157 towards the box body 151 side and a seal 161 and a seal 162 for preventing the leakage of a working fluid.

In addition, the unit 120 has, as shown in FIGS. 1 to 3, an electro-hydraulic servo valve 127 as a fluid volume changing valve having formed therein a port 127*a* communicating with the variable displacement hydraulic pump 111, a port 127*b* communicating with the tank 112, a port 127*c* communicating with the port 122*a* of the hydraulic motor 122, a port 127*d* communicating with the port 122*b* of the hydraulic motor 122 and a port 127*e*, adapted to take any of a first position 127A, a second position 127B and a third position 127C based on the rotating amount of the second toothed shaft 125 and the driving amount of the electric motor 123 and adapted to change the volume of a working fluid discharged by the variable displacement hydraulic pump 111 for supply to the hydraulic motor 122.

Note that the first position 127A is a position where the port 127*a* is made to communicate with the port 127*c* and the port 127*e*, and the port 127*b* is made to communicate with the port 127*d*, the second position 127B is a position where the communication between the port 127*a*, port 127*c* and port 127*d* is cut off, while the port 127*b* is made to communicate with the port 127*e*, and the third position 127C is a position where the communication between the port 127*a*, port 127*d* and port 127*e* is established, and the port 127*b* is made to communicate with the port 127*c*.

Here, the electro-hydraulic servo motor 127 has, as shown in FIGS. 4 to 7, a moving body 171 for changing the communication of the box body 151 with the port 127*a*, port 127*b*, port 127*c*, port 127*d* and port 127*e*, a bearing 172 for transmitting an axial movement of the second toothed shaft 125 to the moving body 171 and a cap 173, a cap 174, the seal 161 and a seal 175 which are adapted to prevent the leakage of working fluid from the inside to the outside of the box body 151.

In addition, the unit 120 has, as shown in FIGS. 1 to 3, a check valve 128*a* (refer to FIG. 5) disposed between the variable displacement hydraulic pump 111 and the port 127*a* of the electro-hydraulic servo valve 127 for preventing the passage of a working fluid from the port 127*a* of the electro-hydraulic servo valve 127 to the variable discharge volume hydraulic valve 111, a check valve 128*b* (refer to FIGS. 6 and 7) disposed between the port 122*a* of the hydraulic motor 122 and the port 127*c* of the electro-hydraulic servo valve 127 and the tank 112 for preventing the passage of a working fluid from the port 122*a* of the hydraulic motor 122 and the port 127*c* of the electro-hydraulic servo valve 127 to the tank 112 and a check valve 128*c* (refer to FIGS. 6 and 7) disposed between the port 122*b* of the hydraulic motor 122 and the port 127*c* of the electro-hydraulic servo valve 127 and the tank 112 for preventing the passage of a working fluid from the port 122*b* of the hydraulic motor 122 and the port 127*c* of the electro-hydraulic servo valve 127 to the tank 112.

In addition, while a detailed description is omitted, the electro-hydraulic actuation system 100 has a unit 130 having a similar configuration to that of the unit 120.

Additionally, the electro-hydraulic actuation system 100 includes a selector valve 141 having formed therein a port 141*a* which communicates with the port 127*e* of the electro-hydraulic servo valve 127 of the unit 120, a port 141*b* which communicates with a port 137*e* of an electro-hydraulic servo valve 137 of the unit 130 and a port 141*c* and adapted to select the port having a maximum pressure of the port 141*a* and the port 141*b* for establishing a communication between the port so selected and the port 141*c*.

In addition, the electro-hydraulic actuation system 100 includes a two-position valve 142 having formed therein a port 142*a* which communicates with the tank 112, a port 142*b* and a port 142*c* which communicate with the variable displacement hydraulic pump 111, a port 142*d* which communicates with the port 141*c* of the selector valve 141 via a throttle valve 140*a* and a port 142*e* and adapted to take either of a first position 142A where the port 142*a* and the port 142*e* are made to communicate with each other in accordance with the pressure of a working fluid supplied to the port 142*c* and the port 142*e* and a second position 142B where the port 142*b* and the port 142*e* are made to communicate with each other.

Additionally, the electro-hydraulic actuation system 100 includes a spring 143 for biasing the two-position valve 142 so that the two-position valve 142 takes the first position 142A when the pressure of a working fluid supplied to the port 142*c* of the two-position valve 142 is equal to or lower than a pressure resulting from adding a predetermined set pressure to the pressure of a working fluid supplied to the port 142*d* of the two-position valve 142.

In addition, the electro-hydraulic actuation system 100 includes a discharge volume changing hydraulic cylinder 144 having formed therein a cylinder chamber 144*a* which communicates with the port 142*e* of the two-position valve 142 via a throttle valve 140*b* and a cylinder chamber 144*b* which communicates with the variable displacement hydraulic pump 111, connected with the variable displacement hydraulic pump 111 in such a manner to increase the discharge volume of the variable displacement hydraulic pump 111 when retracted than extended and adapted to be extended when the pressure of a working fluid within the cylinder chamber 144*a* is equal to or greater than the pressure of a working fluid within the cylinder chamber 144*b* and to be retracted when the pressure of the working fluid within the cylinder chamber 144*a* is smaller than the pressure of the working fluid within the cylinder chamber 144*b*.

Here, the electro-hydraulic servo valve 127 of the unit 120, the electro-hydraulic servo valve 137 of the unit 130, the selector valve 141, the two-position valve 142, the spring 143 and the discharge volume changing hydraulic cylinder 144 constitutes a discharge volume changing means for changing the discharge pressure of a working fluid discharged by the variable displacement hydraulic pump 111 based on a maximum pressure of pressures of the working fluid supplied to the hydraulic motor 122 of the unit 120 and the hydraulic motor 132 of the unit 130 and the discharge pressure of the working fluid discharged by the variable displacement hydraulic pump 111.

In addition, the electro-hydraulic actuation system 100 includes a pressure gauge 145 for detecting the pressure of a working fluid supplied to the port 122*a* of the hydraulic motor 122 of the unit 120, a pressure gauge 146 for detecting the pressure of a working fluid supplied to the port 122*b* of the hydraulic motor 122, a pressure gauge 147 for detecting the pressure of a working fluid supplied to the port 132*a* of the hydraulic motor 132 of the unit 130, a pressure gauge 148 for detecting the pressure of a working fluid supplied to the port 132*b* of the hydraulic motor 132, a pressure gauge 149 for detecting the working fluid discharge pressure of the variable displacement hydraulic pump 111 and a computer, not shown, to which pressures detected by the pressure gauge 145, the pressure gauge 146, the pressure gauge 147, the pressure gauge 148 and the pressure gauge 149 are inputted for changing the rotation speed of the electric motor 123 of the unit 120 and the electric motor 133 of the unit 130 based on the pressures so inputted at substantially the same ratio relative to the electric motor 123 and the electric motor 133.

Here, the pressure gauge 145, the pressure gauge 146, the pressure gauge 147, the pressure gauge 148, the pressure gauge 149 and the computer, not shown, constitute a rotational speed changing means for changing the rotational speed of the electric motor 123 of the unit 120 and the electric motor 133 of the unit 130 at substantially the same ratio relative to the electric motor 123 of the unit 120 and the electric motor 133 of the unit 130 based on a maximum pressure of pressures of the working fluid supplied to the hydraulic motor 122 of the unit 120 and the hydraulic motor 132 of the unit 130 and the working fluid discharge pressure of the variable displacement hydraulic pump 111.

Note that the ration at which the rotational speed of the electric motor 123 and the electric motor 133 may be a constant value at all times or a value which changes in accordance with pressures detected by the pressure gauge 145, the pressure gauge 146, the pressure gauge 147, the pressure gauge 148 and the pressure gauge 149.

Next, the operation of the electro-hydraulic actuation system according to the embodiment will be described.

Note that since the operations of the hydraulic motor 122 and the electro-hydraulic servo valve 127 are substantially similar to those of the conventional hydraulic motor and electro-hydraulic servo valve, the detailed description thereof will be omitted.

The selector valve 141 selects the port where a working fluid supplied shows a maximum pressure of the port 141*a* which communicates with the port 127*e* of the electro-hydraulic servo valve 127 of the unit and the port 141*b* which communicates with the port 137*c* of the electro-hydraulic servo valve 137 of the unit 130 and then establishes a communication between the port so selected and the port 141*c*.

In other words, the selector valve 141 selects a greater pressure of the pressure of the working fluid supplied to the port 127*e* of the electro-hydraulic servo valve 127 of the unit 120 or the load pressure of the hydraulic motor 122 of the unit 120 and the pressure of the working fluid supplied to the port 137*e* of the electro-hydraulic servo valve 137 of the unit 130 or the load pressure of the hydraulic motor 132 of the unit 130.

Since the selector valve 141 selects a greater pressure of the load pressure of the hydraulic motor 122 of the unit 120 and the load pressure of the hydraulic motor 132 of the unit 130, the pressure of the working fluid supplied to the port 142*d* of the two-position valve 142 which communicates with the port 141*c* of the selector valve 141 via the throttle 140*a* becomes the larger pressure of the load pressures of the hydraulic motor 122 and the hydraulic motor 132.

In addition, since the port 142*c* of the two-position valve 142 communicates with the variable displacement hydraulic pump 111, the pressure of the working fluid supplied to the port 142*c* of the two-position valve 142 becomes the working fluid discharge pressure of the variable displacement hydraulic pump 111.

Then, the two-position valve 142 takes the first position 142A where the port 142*a* which communicates with the tank 112 is made to communicate with the port 142*e* when the working fluid discharge pressure of the variable displacement hydraulic pump 111 becomes equal to or smaller than the pressure resulting from adding the predetermined set pressure by the spring 143 to the greater pressure of the load pressures of the hydraulic motor 122 and the hydraulic motor 132.

When the two-position valve 142 takes the first position 142A, the pressure of the working fluid within the cylinder chamber 144*b* of the discharge volume changing hydraulic cylinder 144 which communicates with the port 142*e* of the two-position valve 142 via the throttle 140*b* becomes the pressure of the working fluid within the tank 112.

Here, since the pressure of the working fluid within the cylinder chamber 144*b* of the discharge volume changing hydraulic cylinder 144 which communicates with the variable displacement hydraulic pump 111 is the working fluid discharge pressure of the variable displacement hydraulic pump 111, in the discharge volume changing hydraulic cylinder 144, the pressure of the working fluid within the cylinder chamber 144*a* becomes smaller than the pressure of the working fluid within the cylinder chamber 144*b*, whereby the discharge volume changing hydraulic cylinder 144 retracts to thereby increase the discharge volume of the variable displacement hydraulic pump 111.

In addition, the two-position valve 142 takes the second position 142B where the port 142*b* which communicates with the variable displacement hydraulic pump 111 is made to communicate with the port 142*e* when the working fluid discharge pressure of the variable displacement hydraulic pump 111 becomes greater than the pressure resulting from adding the predetermined set pressure by the spring 143 to the greater pressure of the load pressures of the hydraulic motor 122 of the unit 120 and the hydraulic motor 132 of the unit 130.

When the two-position valve 142 takes the second position 142B, the pressure of the working fluid within the cylinder chamber 144*a* of the discharge volume changing hydraulic cylinder 144 becomes the working fluid discharge pressure of the variable displacement hydraulic pump 111.

Here, as has been described above, since the pressure of the working fluid within the cylinder chamber 144*b* of the discharge volume changing hydraulic cylinder 144 is the working fluid discharge pressure of the variable displacement hydraulic pump 111, in the discharge volume changing hydraulic cylinder 144, the pressure of the working fluid within the cylinder chamber 144*a* becomes equal to or greater than the pressure of the working fluid within the cylinder chamber 144*b*, whereby the discharge volume changing hydraulic cylinder 144 extends to thereby decrease the discharge volume of the variable displacement hydraulic pump 111.

Thus, as has been described heretofore, the electro-hydraulic actuation system 100 changes the working fluid discharge volume of the variable displacement hydraulic pump 111 so that a differential pressure between the greater pressure of the load pressures of the hydraulic motor 122 of the unit 120 and the hydraulic motor 132 of the unit 130 and the working fluid discharge pressure of the variable displacement hydraulic pump 111 becomes the predetermined set pressure by the spring 143.

Consequently, when there occurs no shortage in volume of working fluid supplied to the hydraulic motor 122 of the unit 120 and the hydraulic motor 132 of the unit 130, a smallest pressure (hereinafter, referred to as a minimum differential pressure) of a differential pressure between a pressure detected by the pressure gauge 149 and a pressure detected by the pressure gauge 145, a differential pressure between the pressure detected by the pressure gauge 149 and a pressure detected by the pressure gauge 146, a differential pressure between the pressure detected by the pressure gauge 149 and a pressure detected by the pressure gauge 147, and a differential pressure between the pressure detected by the pressure gauge 149 and a pressure detected by the pressure gauge 148 becomes the predetermined set pressure by the spring 143.

Here, when there occurs even a slight shortage in volume of the working fluid supplied to the hydraulic motor 122 of the unit 120 and the hydraulic motor 132 of the unit 130, the pressure detected by the pressure gauge 149 or the working fluid discharge pressure of the variable displacement hydraulic pump 111 decreases, the minimum differential pressure becomes smaller than the predetermined set pressure by the spring 143.

Consequently, by determining whether or not the minimum differential pressure becomes smaller than the predetermined set pressure by the spring 143 based on pressures inputted from the pressure gauge 145, the pressure gauge 146, the pressure gauge 147, the pressure gauge 148 and the pressure gauge 149, the computer, not shown, can determine whether or not there occurs a shortage in volume of the working fluid supplied to either of the hydraulic motor 122 of the unit 120 and the hydraulic motor 132 of the unit 130.

Then, when the minimum differential pressure becomes smaller than the predetermined set pressure by the spring 143, the computer, not shown, determines that there occurs a shortage in volume of the working fluid supplied to either of the hydraulic motor 122 of the unit 120 and the hydraulic motor 132 of the unit 130 and then decreases the rotational speed of the electric motor 123 of the unit 120 and the electric motor 133 of the unit 130 at substantially the same ratio relative to the electric motor 123 and the electric motor 133.

When the computer, not shown, decreases the rotational speed of the electric motor 123 of the unit 120 and the electric motor 133 of the unit 130 at substantially the same ratio relative to the electric motor 123 and the electric motor 133, a total volume of working fluid needed to be supplied to the hydraulic motor 122 of the unit 120 and the hydraulic motor 132 of the unit 130 is decreased, and the shortage of working fluid that is occurring in either of the hydraulic motor 122 of the unit and the hydraulic motor 132 of the unit 130 can be eliminated.

As has been described heretofore, since the electro-hydraulic actuation system 100 can decrease the volume of the working fluid supplied to the hydraulic motor 122 of the unit 120 and the hydraulic motor 132 of the unit 130 at substantially the same ratio when there occurs a shortage in volume of working fluid supplied to the hydraulic motor 122 of the unit 120 and the hydraulic motor 132 of the unit 130, the occurrence of a shortage in volume of working fluid supplied to the hydraulic motor having a larger load pressure of the hydraulic motor 122 of the unit 120 and the hydraulic motor 132 of the unit 130 can be prevented.

In addition, since the electro-hydraulic actuation system 100 can decrease the volume of the working fluid supplied to the hydraulic motor 122 of the unit 120 and the hydraulic motor 132 of the unit 130 at substantially the same ratio, for example, in a case where the hydraulic motor 122 of the unit 120 is used for a right side caterpillar of a hydraulic shovel and the hydraulic motor 132 of the unit 130 is used for a left side caterpillar of the hydraulic shovel, when the operator attempts to move the hydraulic shove straight forward by inputting substantially the same operation amounts into the unit 120 and the unit 130, even in case a load borne by the right side caterpillar becomes larger than a load borne by the left side caterpillar due to the right side caterpillar riding on a stone or the left side caterpillar entering a puddle, the movement of the right side caterpillar and the movement of the left side caterpillar can be made slower at substantially the same ratio.

Figure 22:
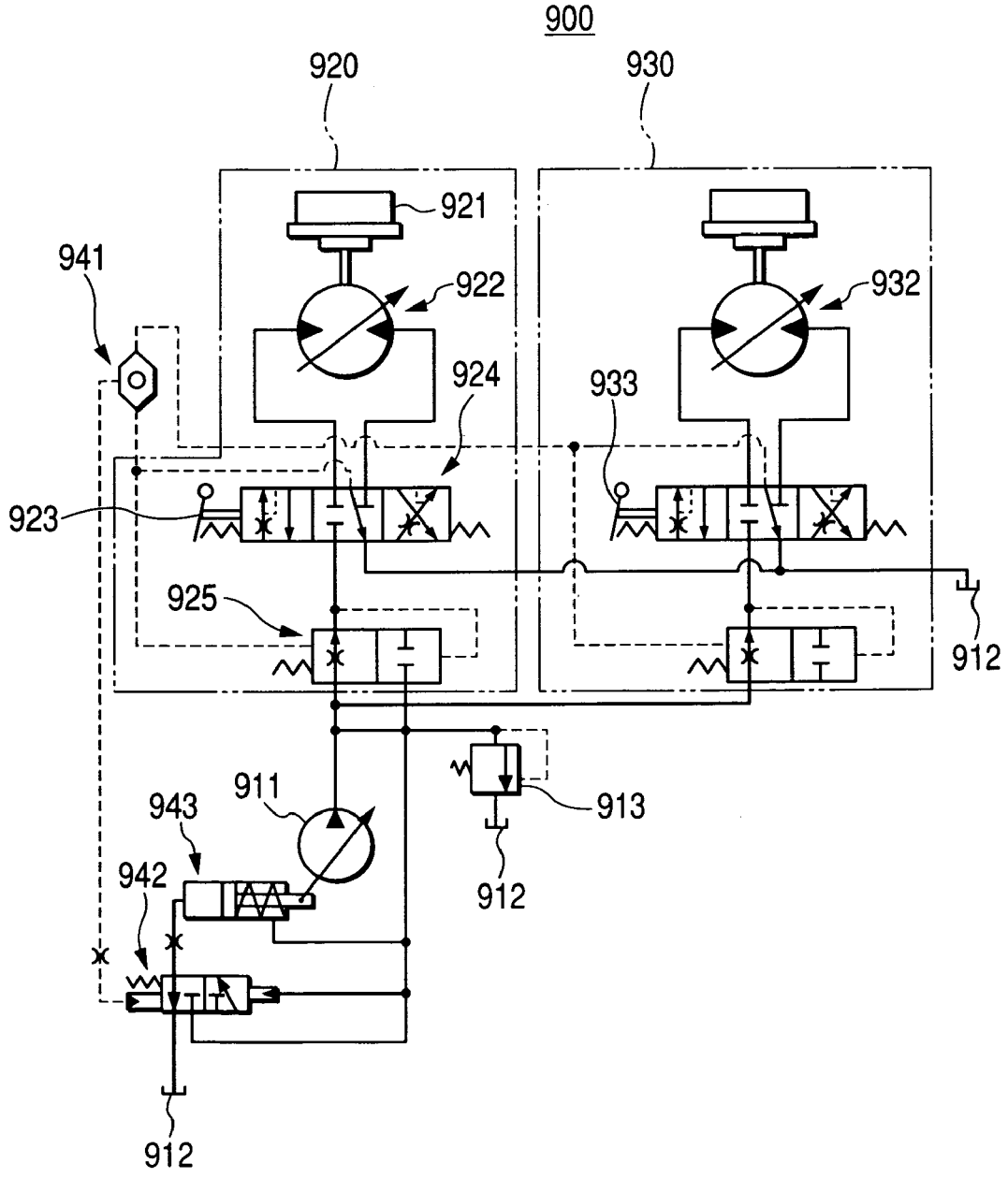
FIG. 22 is a hydraulic circuit diagram of a conventional electro-hydraulic actuation system.
Figure 23:
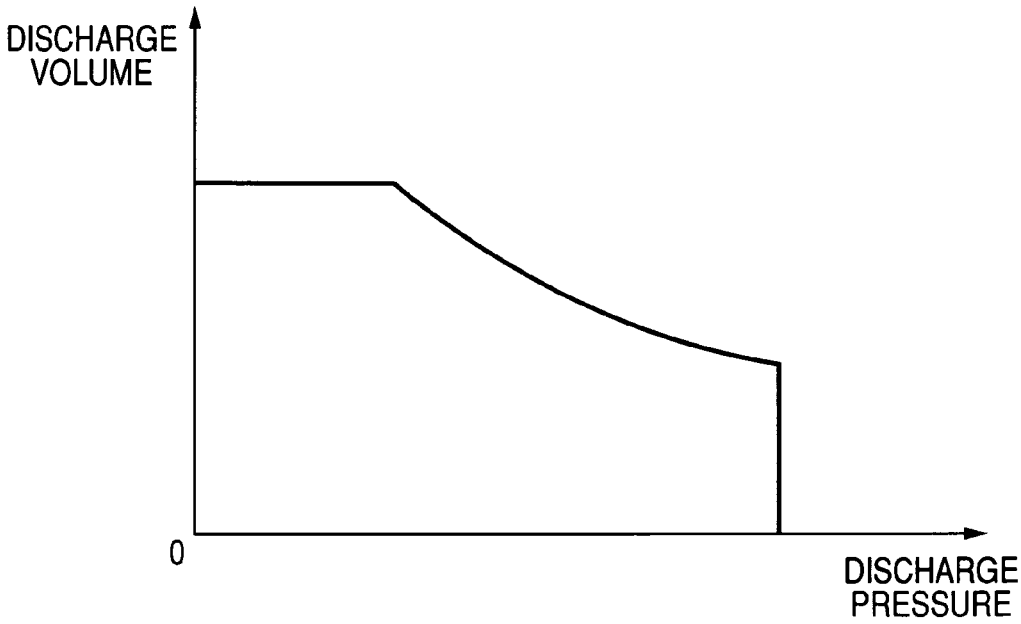
FIG. 23 is a diagram showing the discharge volume and discharge pressure of a variable displacement hydraulic pump of the electro-hydraulic actuation system shown in FIG. 22.

Consequently, since the moving direction of the hydraulic shovel provided with the electro-hydraulic actuation system 100 is maintained while the moving speed thereof gets slower, a risk of a hydraulic shovel moving in a direction different from the direction intended by the operator can be prevented, which is the case with a hydraulic shovel provided with the conventional hydraulic actuation system 900 (refer to FIG. 22).

(Second Embodiment)

Firstly, the configuration of an electro-hydraulic actuation system according to a second embodiment will be described.

Figure 8:
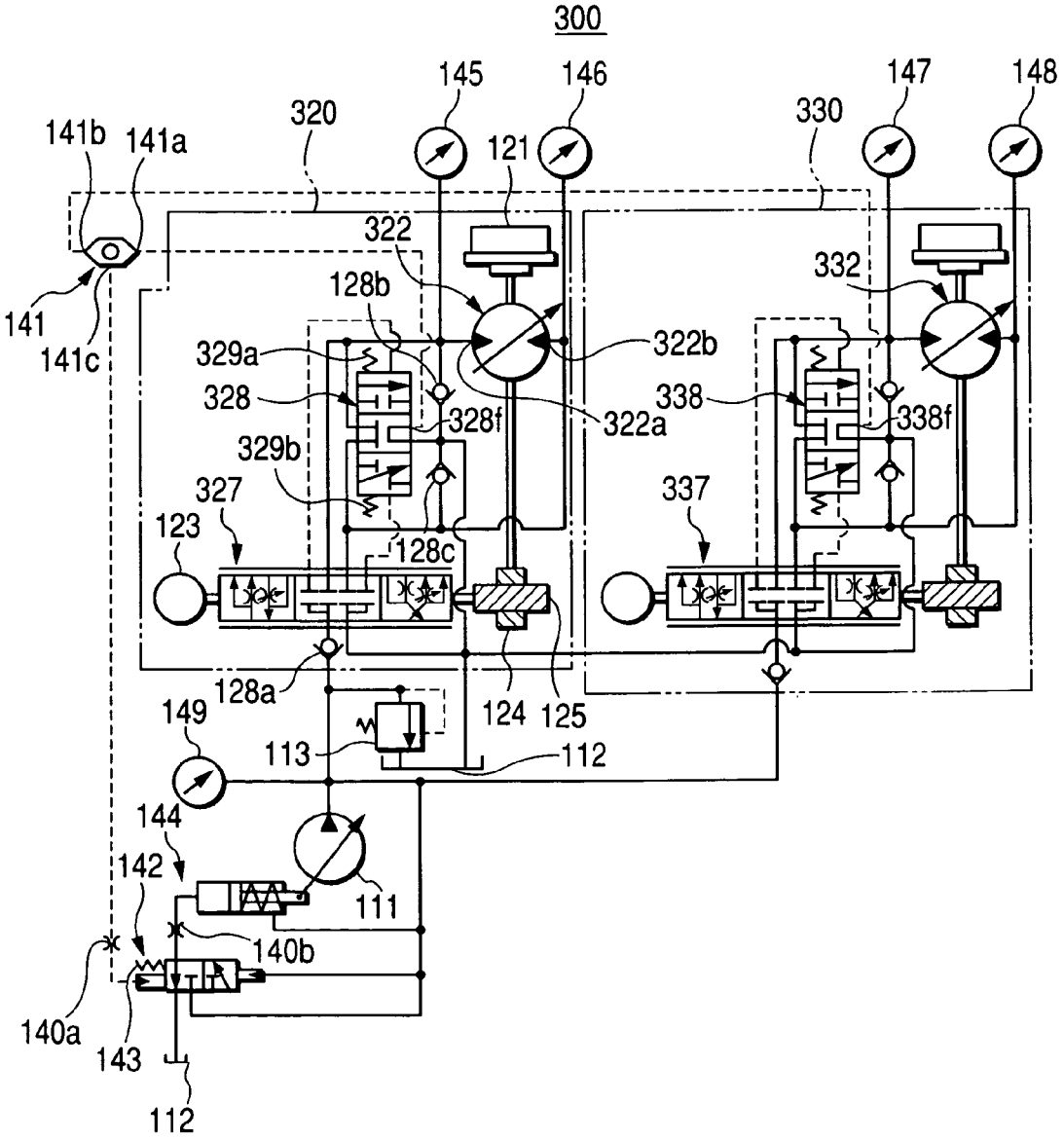
FIG. 8 is a hydraulic circuit diagram of an electro-hydraulic actuation system according to a second embodiment of the invention.
Figure 9:
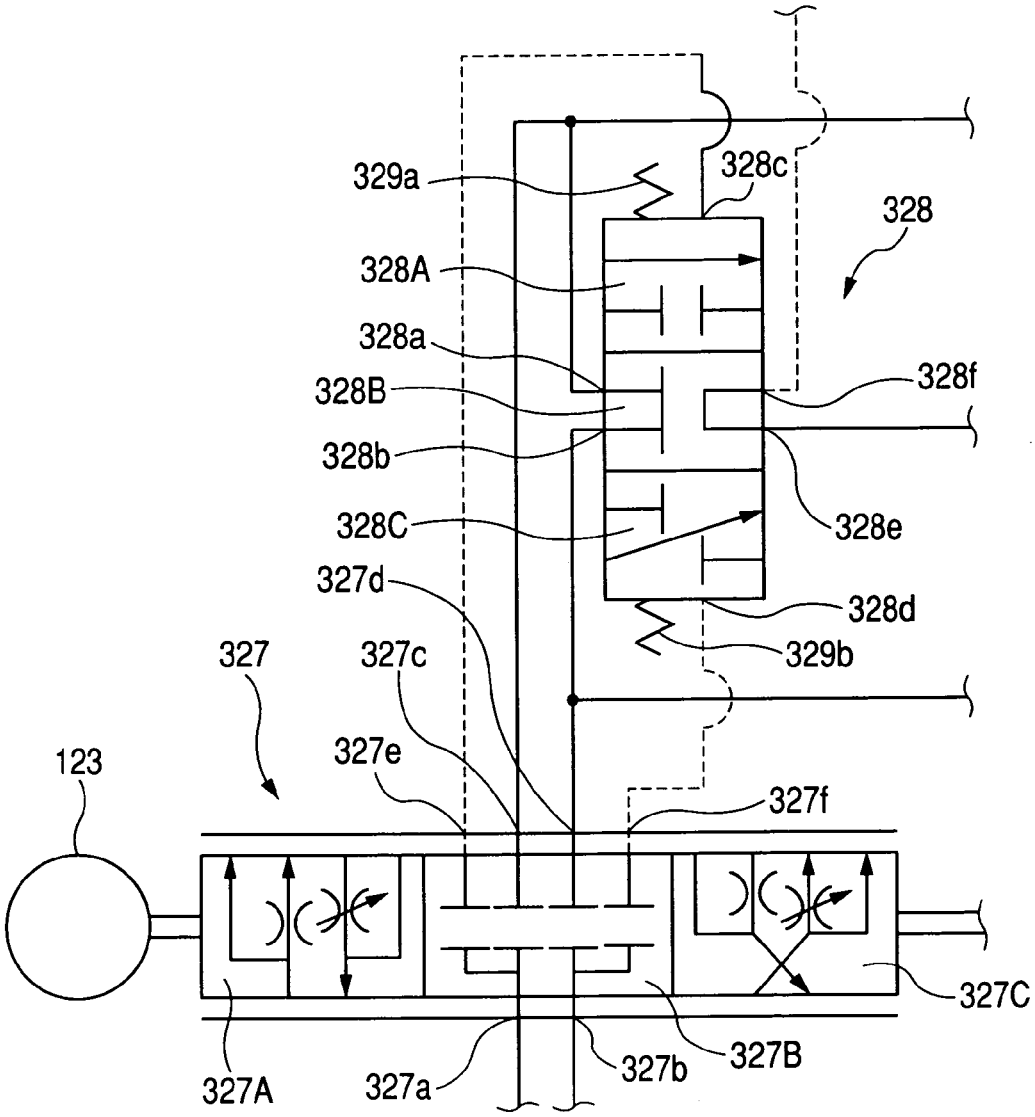
FIG. 9 is a hydraulic circuit diagram of the electro-hydraulic actuation system shown in FIG. 8 in the vicinity of an electro-hydraulic servo valve thereof.
Figure 10:
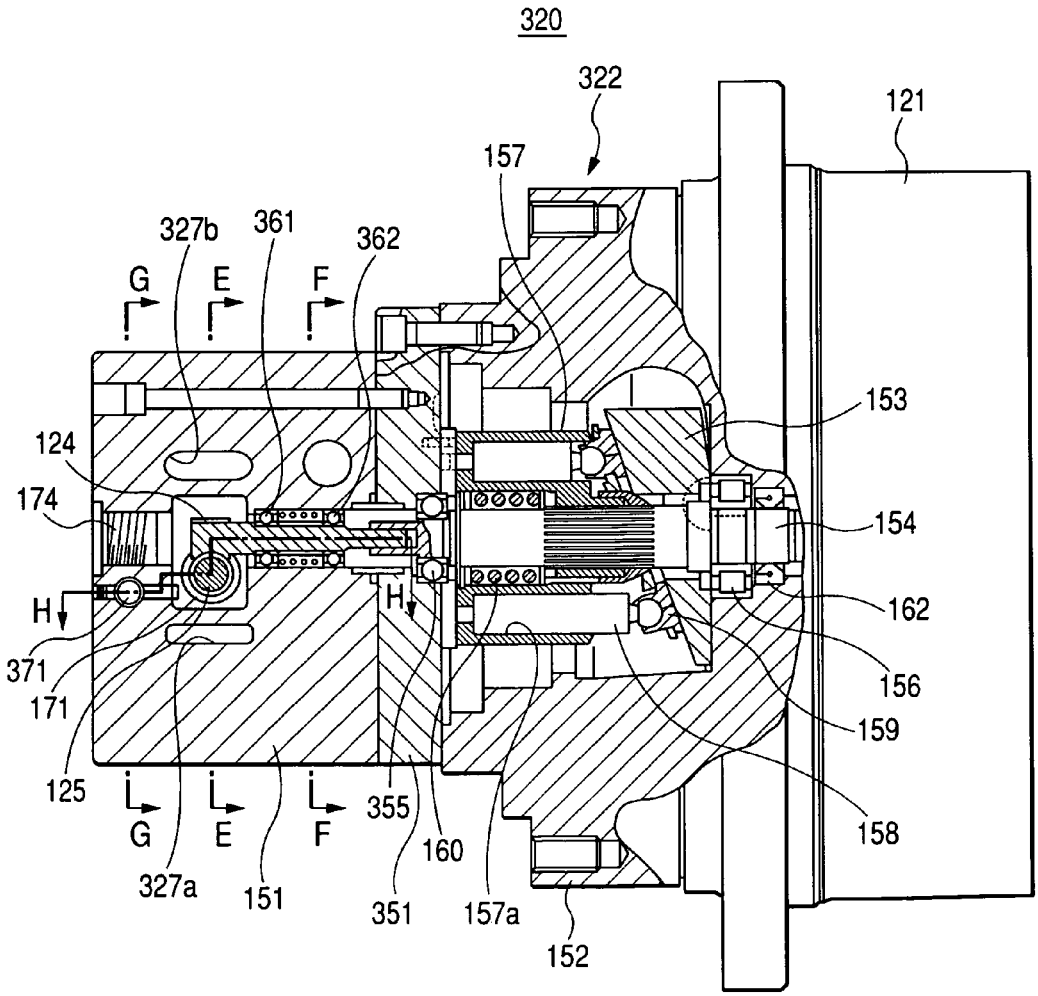
FIG. 10 is a sectional view of a unit of the electro-hydraulic actuation system shown in FIG. 8.
Figure 11:
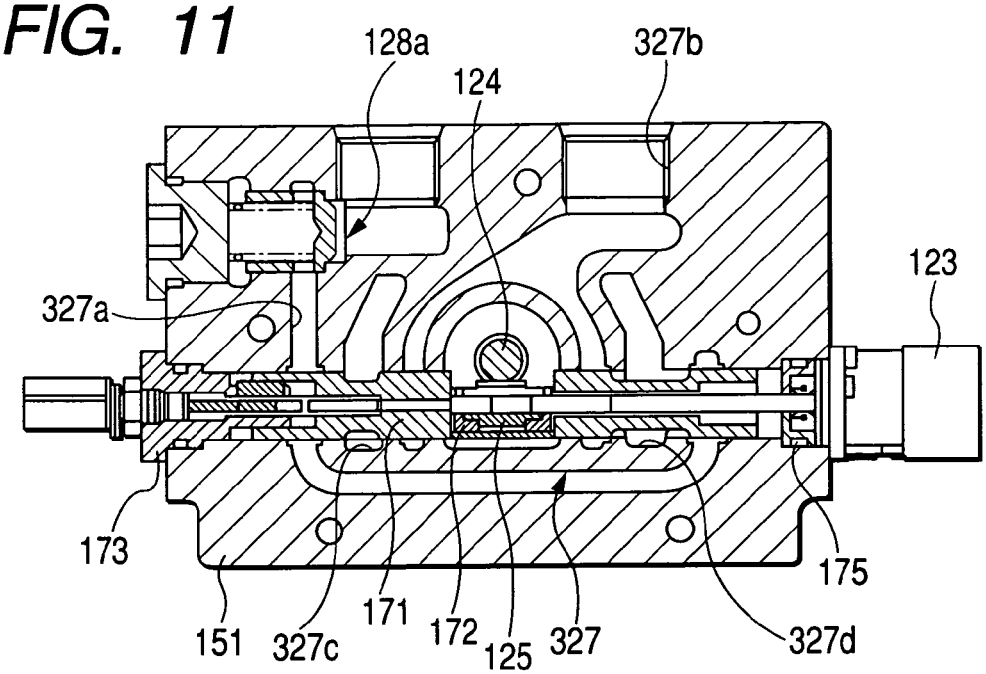
FIG. 11 is a sectional view taken along the line indicated by arrows E—E in FIG. 10 and viewed in a direction indicated by the arrows.
Figure 12:
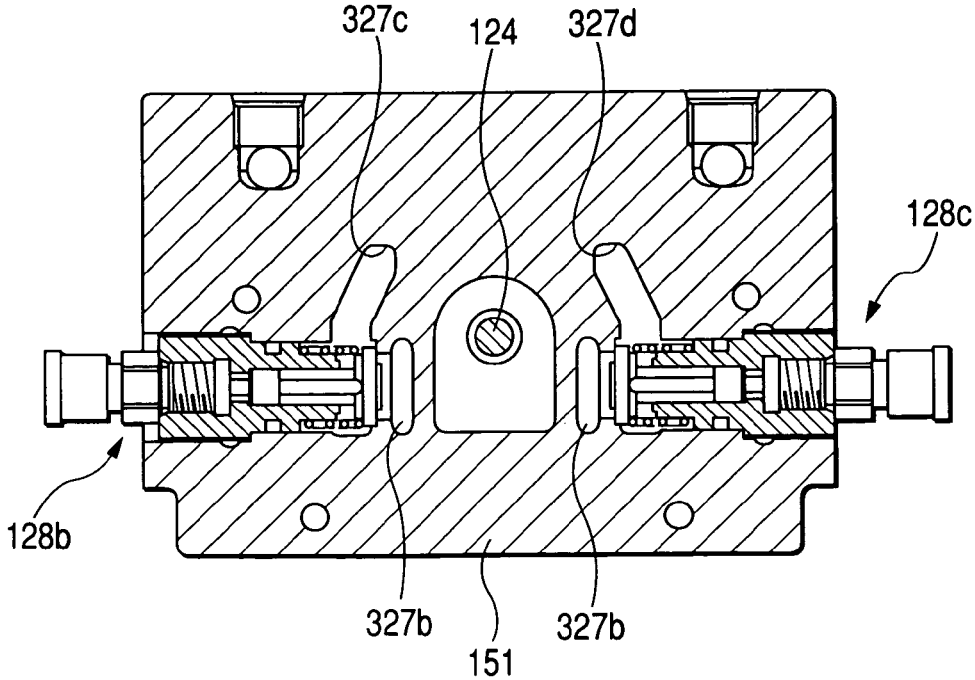
FIG. 12 is a sectional view taken along the line indicated by arrows F—F in FIG. 10 and viewed in a direction indicated by the arrows.
Figure 13:
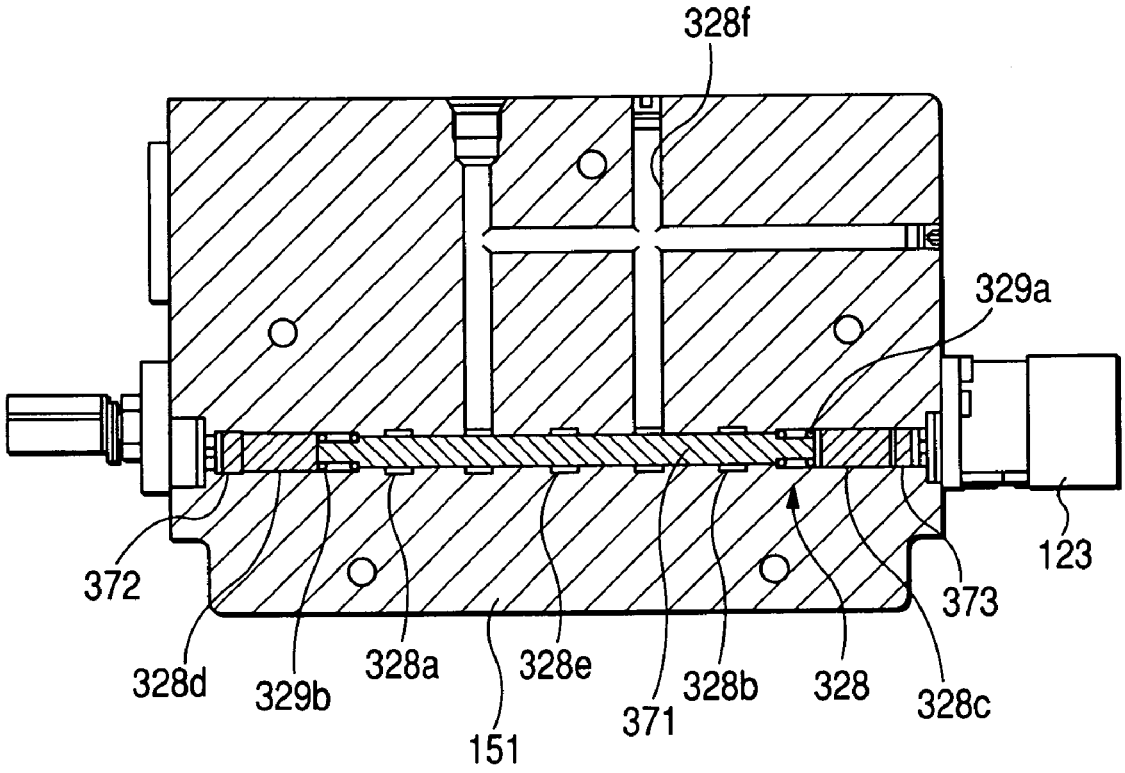
FIG. 13 is a sectional view taken along the line indicated by arrows G—G in FIG. 10 and viewed in a direction indicated by the arrows.
Figure 14:
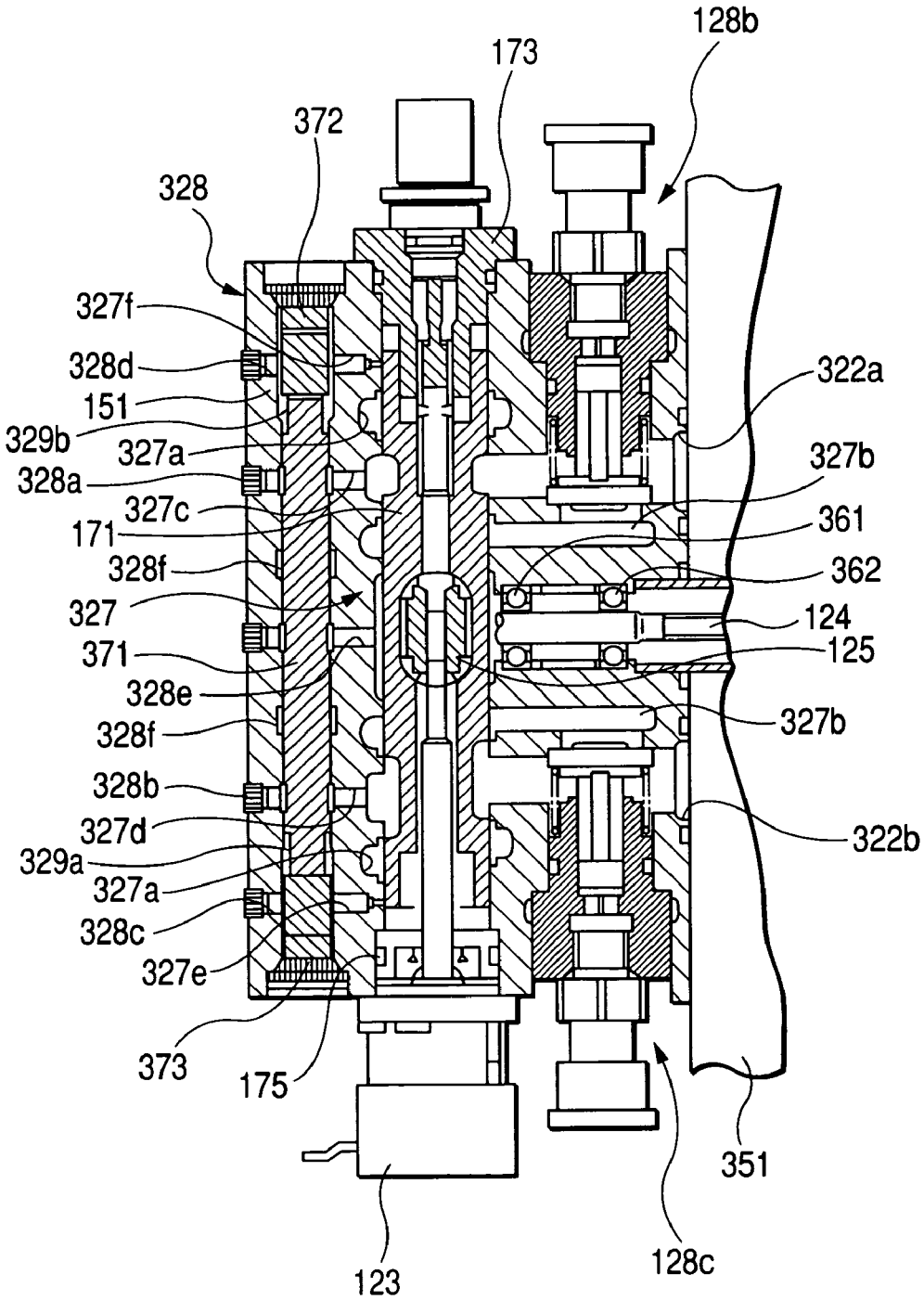
FIG. 14 is a sectional view taken along the line indicated by arrows H—H in FIG. 10 and viewed in a direction indicated by the arrows.

As shown in FIGS. 8 and 9, since an electro-hydraulic actuation system 300 as an electro-hydraulic actuation system according to the second embodiment has a substantially similar configuration to that of the electro-hydraulic actuation system (refer to FIG. 1) according to the first embodiment, hereinafter, like reference numerals are imparted to constituent parts of the electro-hydraulic actuation system 300 which are substantially like to those of the electro-hydraulic actuation system 100 and the detailed description thereof will be omitted.

Instead of the unit 120 (refer to FIG. 1) and the unit 130 (refer to FIG. 1) of the electro-hydraulic actuation system 100 (refer to FIG. 1), the electro-hydraulic actuation system 300 includes an electro-hydraulic actuator 320 (refer to FIGS. 10 to 14) and a unit 330, the detailed description of which will be omitted, having a similar configuration to that of the unit 320.

Instead of the hydraulic motor 122 (refer to FIG. 1) of the unit 120 (refer to FIG. 1), the unit 320 has a variable displacement hydraulic motor 322 as a hydraulic actuator having formed therein a port 322*a* and a port 322*b* which are made to communicate with a variable displacement hydraulic pump 111 or a tank 112 and adapted to impart a driving force to reduction gears 121 by virtue of the pressure of a working fluid supplied to the port 322*a* and the port 322*b*.

Here, the variable displacement hydraulic motor 322 has, as shown in FIGS. 10 to 14, a box body 351, a box body 152 fixed to the box body 351, a swash plate 153, a motor shaft 154, a bearing 355 for rotatably supporting the motor shaft 154 on the box body 351, a bearing 156, a cylinder bock 157 having formed therein a plurality of cylinder chambers 157*a*, a plurality of pistons 158, shoe members 0.159, a spring 160 and a seal 162.

In addition, instead of the electro-hydraulic servo valve 127 (refer to FIG. 1) of the unit 120 (refer to FIG. 1), the unit 320 has, as shown in FIGS. 8 and 9, an electro-hydraulic servo valve 327 as a fluid volume changing valve having formed therein a port 327*a* which communicates with the variable displacement hydraulic pump 111, a part 327*b* which communicates with the tank 112, a port 327*c* which communicates with the port 322*a* of the variable displacement hydraulic motor 322, a part 327*d* which communicates with the port 322*b* of the variable displacement hydraulic motor 322, a port 327*e* and a port 327*f*, adapted to take any of a first position 327A, a second position 327B and a third position 328C based on the rotating amount of a second toothed shaft 125 and the driving amount of an electric motor 123 and adapted to change the volume of a working fluid discharged by the variable displacement hydraulic pump 111 for supply to the variable displacement hydraulic motor 322.

Note that the first position 327A is a position where the port 327*a* is made to communicate with the port 327*c* and the port 327*e* and a communication of the port 327*b* with the port 327*d* and the port 327*f* is established, the second position 327B is a position where the communication with the port 327*a*, the port 327*b*, the port 327*c*, the port 327*d*, the port 327*e* and the port 327*f* is cut off, and the third position 327C is a position where the port 327*a* is made to communicate with the port 327*d* and the port 327*f* and a communication of the port 327*d* with the port 327*c* and the port 327*e* is established.

Here, as shown in FIGS. 10 to 14, the electro-hydraulic servo valve 327 has a box body 151, a moving body 171 for changing the communication of the port 327*a*, the port 327*b*, the port 327*c*, the port 327*d*, the port 327*e* and the port 327*f*, a bearing 172 for transmitting an axial movement of the second toothed shaft 125 to the moving body 171 and a cap 173, a cap 174 and a seal 175 which prevent the leakage of a working fluid from the inside to the outside of the box body 151.

Note that the unit 320 has a bearing 361 and a bearing 362 which rotatably support a first toothed shaft 124 relative to the box body 151.

In addition, as shown in FIGS. 8 and 9, the unit 320 has a load pressure selector valve 328 having formed therein a port 328*a* which communicates with the port 327*c* of the electro-hydraulic servo valve 327, a port 328*b* which communicates with the port 327*d* of the electro-hydraulic servo valve 327, a part 328*c* which communicates with the port 327*e* of the electro-hydraulic servo valve 327, a port 328*d* which communicates with the port 327*f* of the electro-hydraulic servo valve 327, a port 328*e* which communicates with the tank 112 and a port 328*f* which communicates with a port 141*a* of a selector valve 141, adapted to take any of the first position 328A, the second position 328B and the third position 328C based on the pressure of a working fluid supplied to the port 328*c* and the port 328*d* and adapted to make either of the port 328*a* and the port 328*b* to which a working fluid having a greater pressure is supplied communicate with the port 328*e* for selection of the load pressure of the variable displacement hydraulic motor 322.

Note that the first position 328A is a position where the port 328*a* is made to communicate with the port 328*f* and the communication between the port 328*b* and the port 328*e* is cut off, the second position 328B is a position where the communication of the port 328*a* and the port 328*b* is cut off and the port 328*e* is made to communicate with the port 328*f*, and the third position 328C is a position where the communication of the port 328*a* and the port 328*e* are cut off and the port 328*b* is made to communicate with the port 328*f*.

Here, the load pressure selector valve 328 has, as shown in FIGS. 10 to 14, the box body 151, a moving body 371 for changing the communication of the port 328*a*, the port 328*b*, the port 328*c*, the port 328*d*, the port 328*e* and the port 328*f*, a spring 329*a* for biasing the moving body 371 so that the moving body 371 is located at a first position 328A (refer to FIG. 9), a spring 329*b* for biasing the moving body 371 so that the moving body is located at a third position 328C (refer to FIG. 9) and a cap 372 and a cap 373 which prevent the leakage of the working fluid from the inside to the outside of the box body 151.

Note that the electro-hydraulic servo valve 327 of the unit 320, the load pressure selector valve 328, an electro-hydraulic servo valve 337 of the unit 330, a load pressure selector valve 338, a selector valve 141, a spring 142 and a discharge volume changing hydraulic cylinder 144 constitutes a discharge volume changing means for changing the working fluid discharge volume of the variable displacement hydraulic pump 111 based on a maximum pressure of pressures of the working fluid supplied to the variable displacement hydraulic motor 322 of the unit 320 and a variable displacement hydraulic motor 332 of the unit 330 and the working fluid discharge pressure of the variable displacement hydraulic pump 111.

Next, the operation of the electro-hydraulic actuation system according to the embodiment will be described.

Note that the detailed description of those of operations of the electro-hydraulic actuation system 300 according to the embodiment will be omitted which are substantially similar to the operations of the electro-hydraulic actuation system 100 (refer to FIG. 1) according to the first embodiment.

The load pressure selector valve 328 takes the first position 328A where a communication of the port 328*a* and the port 328*f* is established when the pressure of the working fluid supplied to the port 328*c* is greater than the pressure of the working fluid supplied to the port 328*d*, and takes a second position 328B when the pressure of the working fluid supplied to the port 328*c* is the same as the pressure of the working fluid supplied to the port 328*d*, and takes the third position 328C where a communication of the port 328*b* and the port 328*f* is established when the pressure of the working fluid supplied to the port 328*c* is smaller than the pressure of the working fluid supplied to the port 328*d*.

In addition, the electro-hydraulic servo valve 327 allows the port 327*c* which communicates with the port 328*a* of the load pressure selector valve 328 to communicate with the port 327*e* which communicates with the port 328*c* of the load pressure selector valve 328 when the electro-hydraulic servo valve 327 makes the port 327*a* which communicates with the variable displacement hydraulic pump 111 or the port 327*b* which communicates with the tank 112 communicate with the port 327*c*, and allows the port 327*d* which communicates with the port 328*d* of the load pressure selector valve 328 to communicate with the port 327*f* which communicates with the port 328*d* of the load pressure selector valve 328 when the electro-hydraulic servo valve 327 makes the port 327*a* or the port 327*b* communicate with the port 327*d*.

Consequently, the pressure of the working fluid supplied to the port 328*f* of the load pressure selector valve 328 or the pressure of the working fluid supplied to a port 141*a* of the selector valve 141 becomes the load pressure of the variable displacement hydraulic motor 322 of the unit 320.

Similarly, the pressure of a working fluid supplied to a port 338*f* of the load pressure selector valve 338 or the pressure of a working fluid supplied to a port 141*b* of the selector valve 141 becomes the load pressure of the variable displacement hydraulic motor 332 of the unit 330.

Since the pressure of the working fluid supplied to the port 141*a* of the selector valve 141 becomes the load pressure of the variable displacement hydraulic motor 322 of the unit 320 and the pressure of the working fluid supplied to the port 141*b* of the selector valve 141 becomes the load pressure of the variable displacement hydraulic motor 332 of the unit 330, as has been described in the first embodiment, the electro-hydraulic actuation system 300 can change the working fluid discharge volume of the variable displacement hydraulic pump 111 so that a differential pressure between a larger load pressure of the load pressures of the variable displacement hydraulic motor 322 of the unit 320 and the variable displacement hydraulic motor 332 of the unit 330 and the working fluid discharge pressure of the variable displacement hydraulic pump 111 becomes a predetermined set pressure by the spring 143.

(Third Embodiment)

Firstly, the configuration of an electro-hydraulic actuation system according to a third embodiment will be described.

Figure 15:
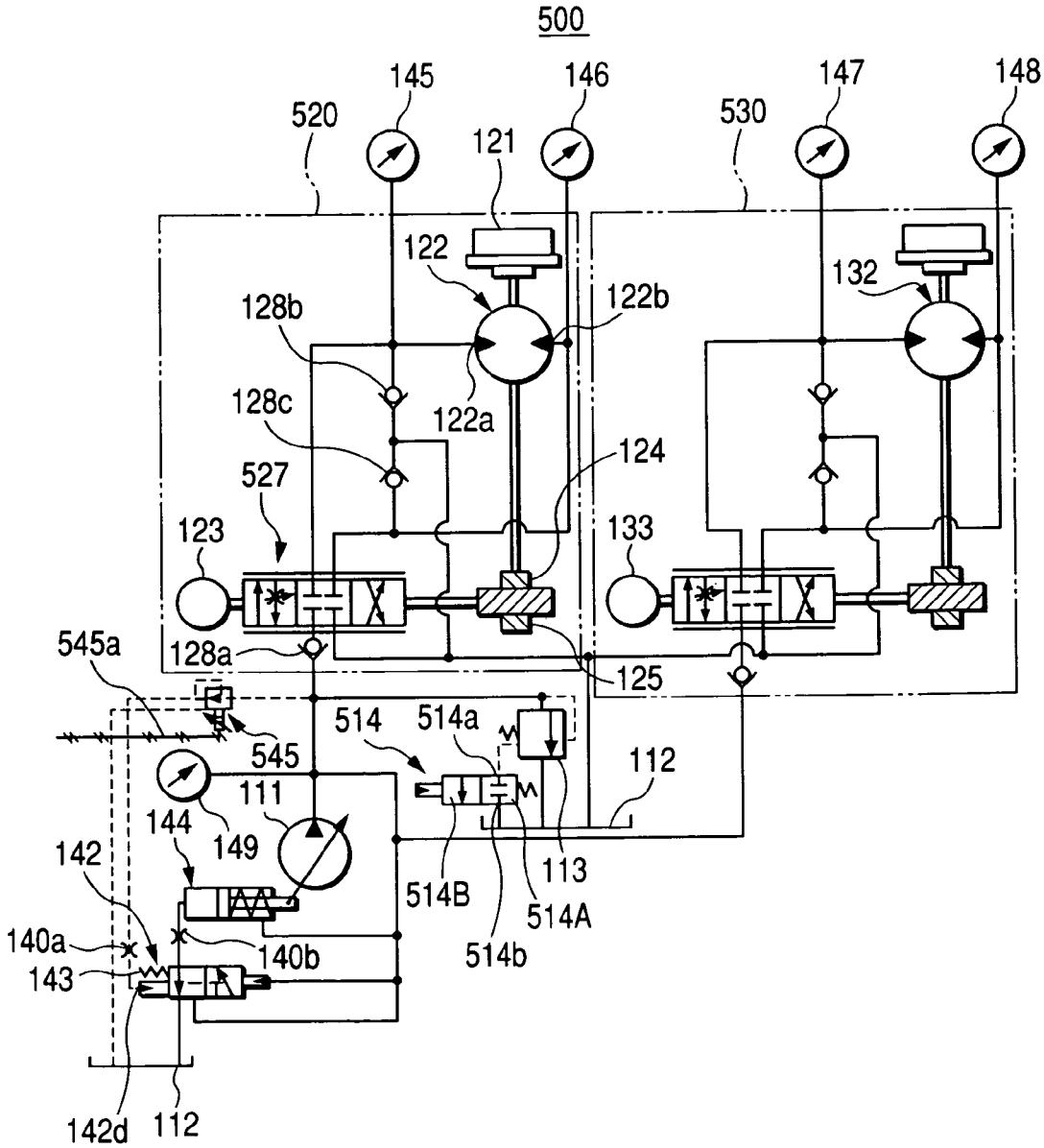
FIG. 15 is a hydraulic circuit diagram of an electro-hydraulic actuation system according to a third embodiment of the invention.
Figure 16:
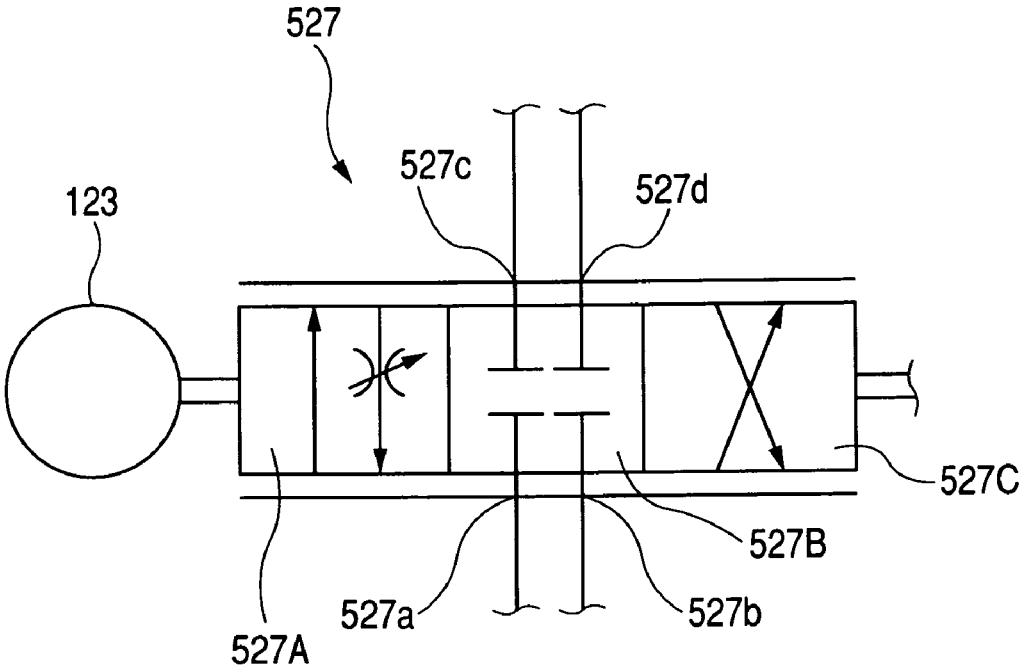
FIG. 16 is a hydraulic circuit diagram of the electro-hydraulic actuation system shown in FIG. 15 in the vicinity of an electro-hydraulic servo valve thereof.
Figure 17:
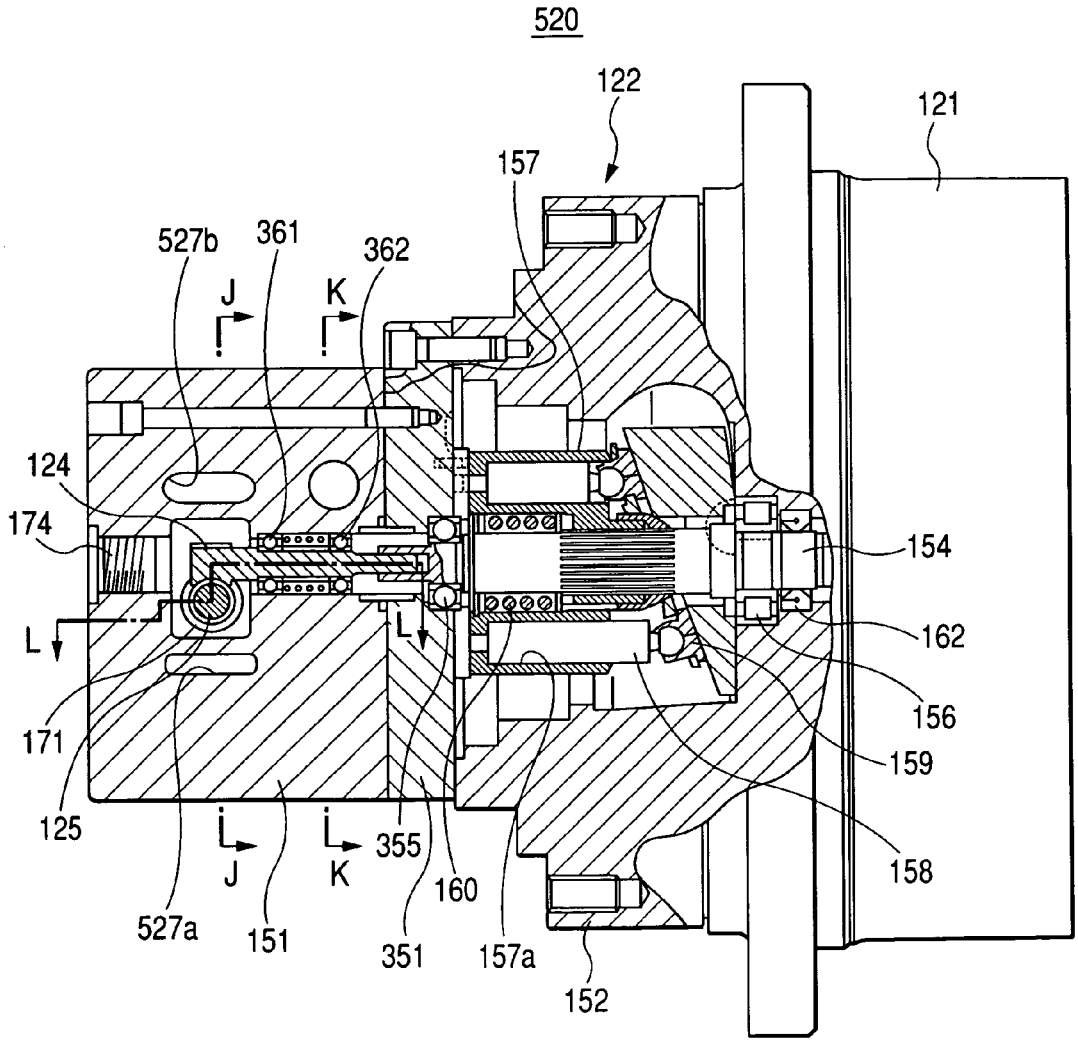
FIG. 17 is a sectional view of a unit of the electro-hydraulic actuation system shown in FIG. 15.
Figure 18:
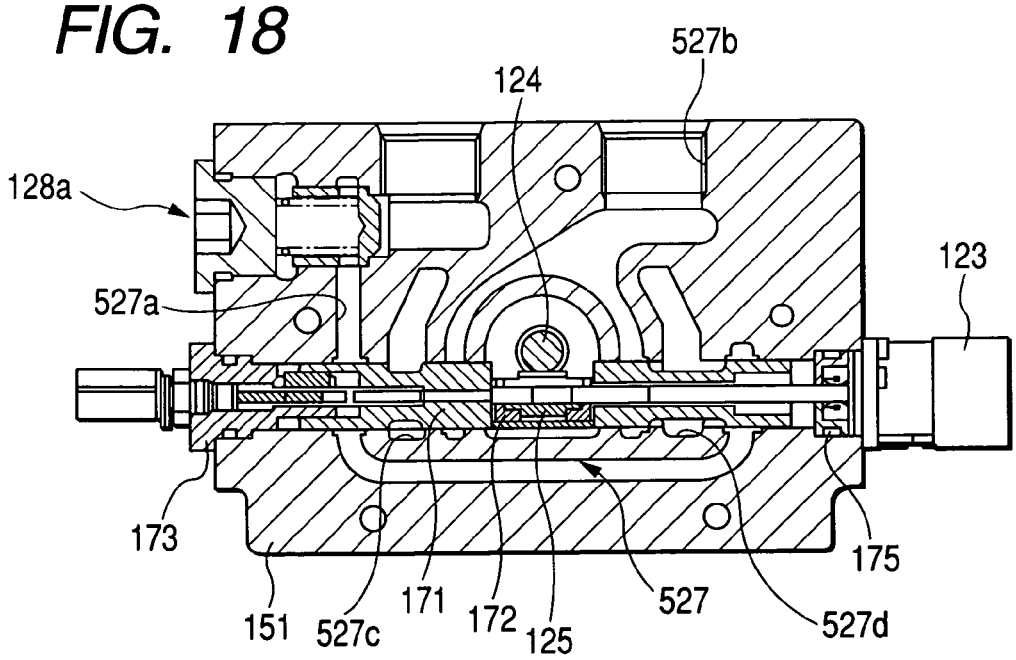
FIG. 18 is a sectional view taken along the line indicated by arrows J—J in FIG. 17 and viewed in a direction indicated by the arrows.
Figure 19:
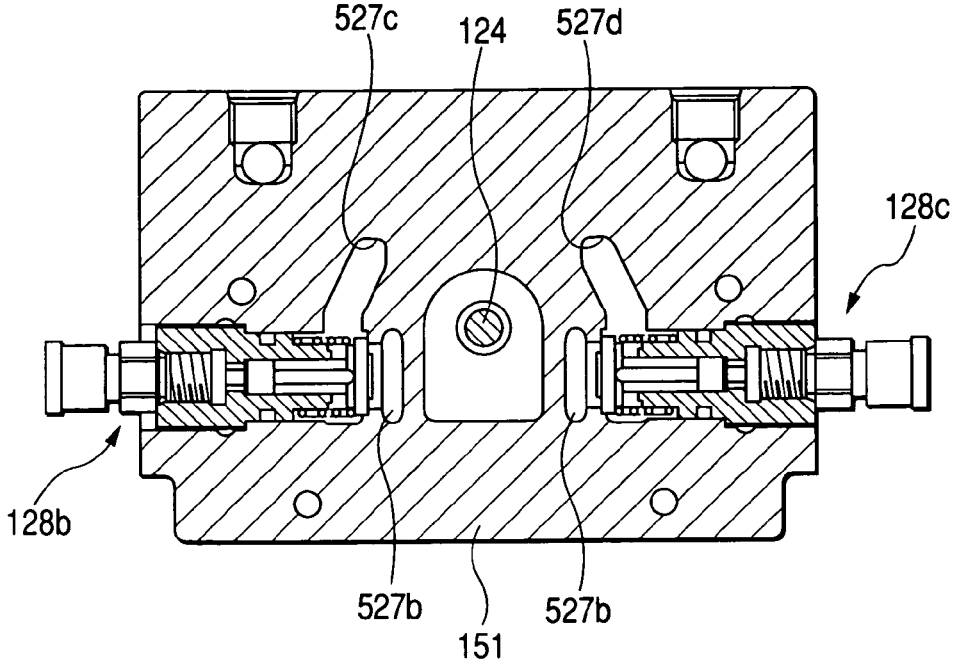
FIG. 19 is a sectional view taken along the line indicated by arrows K—K in FIG. 17 and viewed in a direction indicated by the arrows.
Figure 20:
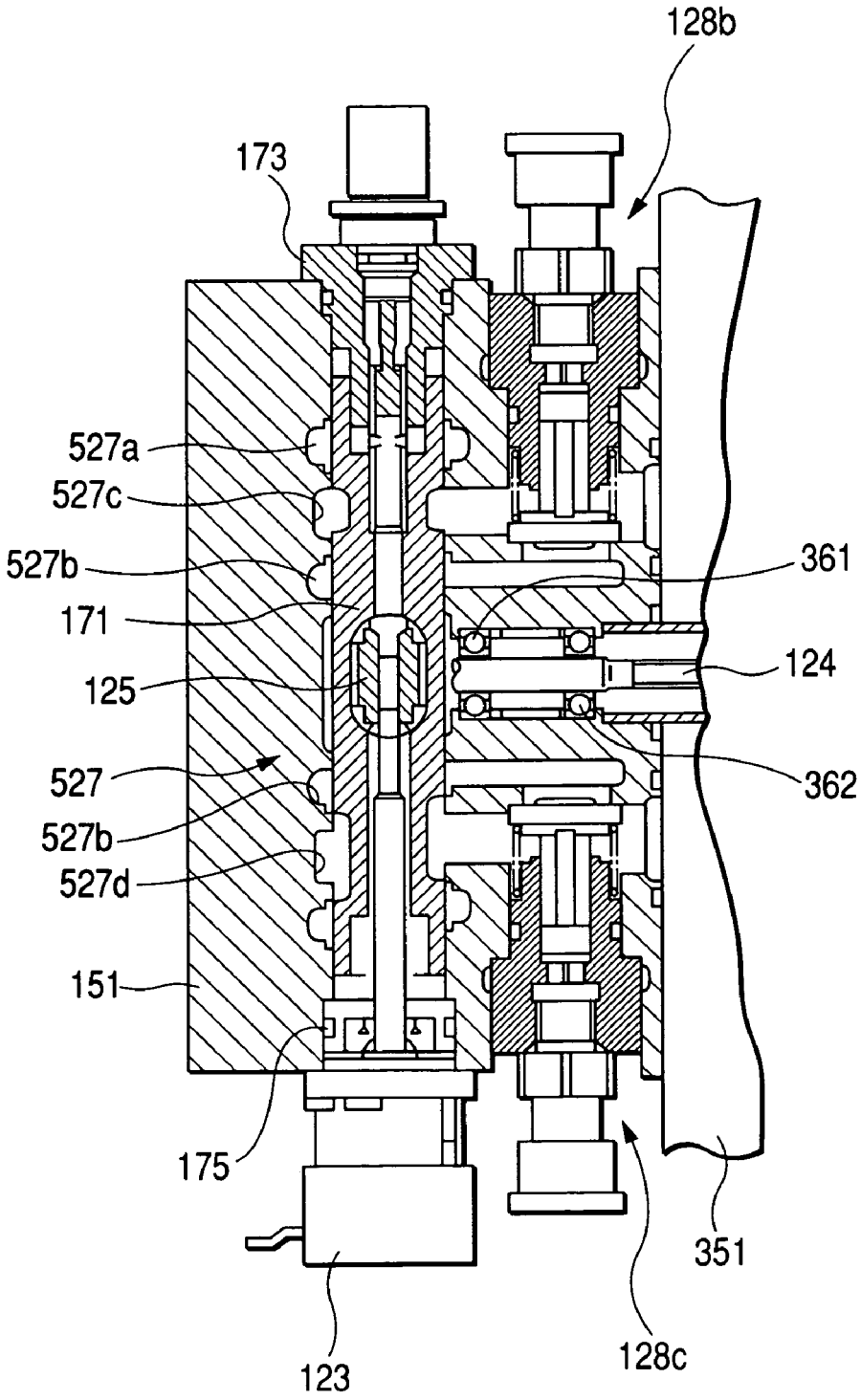
FIG. 20 is a sectional view taken along the line indicated by arrows L—L in FIG. 17 and viewed in a direction indicated by the arrows.

As shown in FIGS. 15 and 16, since an electro-hydraulic actuation system 500 as an electro-hydraulic actuation system according to the embodiment has a configuration which is substantially similar to that of the electro-hydraulic actuation system 100 (refer to FIG. 1) according to the first embodiment or the electro-hydraulic actuation system 300 (refer to FIG. 8) according to the second embodiment, hereinafter, like reference numerals are imparted to constituent parts of the electro-hydraulic actuation system 500 which are substantially like to those of the electro-hydraulic actuation system 100 or the electro-hydraulic actuation system 300, and the detailed description thereof will be omitted.

The electro-hydraulic actuation system 500 includes, as electro-hydraulic actuators, a unit 520 (refer to FIGS. 17 to 20) and a unit 530, the detailed description of which will be omitted, having a similar configuration to that of the unit 520, instead of the unit 120 (refer to FIG. 1) and the unit 130 (refer to FIG. 1) of the electro-hydraulic actuation system 100 (refer to FIG. 1).

The unit 520 has, instead of the electro-hydraulic servo valve 127 of the unit 120 (refer to FIG. 1), an electro-hydraulic servo valve 527 as a fluid volume changing valve having formed therein a port 527*a* which communicates with a variable displacement hydraulic pump 111, a port 527*b* which communicates with a tank 112, a port 527*c* which communicates with a port 122*a* of a hydraulic motor 122 and a port 527*d* which communicates with a port 122*b* of the hydraulic motor 122, adapted to take any of a first position 527A, a second position 527B and a third position 527C based on the rotating amount of a second toothed shaft 125 and the driving amount of an electric motor 123 and adapted to change the volume of a working fluid discharged by the variable displacement hydraulic pump 111 for supply to the hydraulic motor 122.

Note that the first position 527A is a position where the port 527*a* is made to communicate with the port 527*c*, and the port 527*b* is made to communicate with the port 527*d*, the second position 527B is a position where the communication of the port 527*a*, the port 527*b*, the port 527*c* and the port 527*d* is cut off, and the third position 527C is a position where the port 527*a* is made to communicate with the port 527*d*, and the port 527*b* is made to communicate with the port 527*c*.

Here, as shown in FIGS. 17 to 20, the electro-hydraulic servo valve 527 has a box body 151, a moving body 171 for changing the communication of the port 527*a*, the port 527*b*, the port 527*c* and the port 527*d*, a bearing 172 for transmitting an axial movement of the second toothed shaft 125 to the moving body 171 and a cap 173, a cap 174 and a seal 175 which prevent the leakage of a working fluid from the inside to the outside of the box body 151.

In addition, as shown in FIG. 15, the electro-hydraulic actuation system 500 includes a two-position electromagnetic valve 514 having formed therein a port 514*a* which communicates with a relief valve 113 and a port 514*b* which communicates with the tank 112 and adapted to take either of a first position 514A where the communication of the port 514*a* and the port 514*b* is cut off based on a signal inputted and a second position 514B where the communication of the port 514*a* and the port 514*b* is established.

In addition, instead of the selector valve 141 (refer to FIG. 1 or 8) of the electro-hydraulic actuation system 100 (refer to FIG. 1) or the electro-hydraulic actuation system 300 (refer to FIG. 8), the electro-hydraulic actuation system 500 includes a pressure setting valve 545 for setting a pressure for a working fluid supplied to a port 142*d* of a two-position valve 142 by being switched between a position where a working fluid discharged by the variable displacement hydraulic pump 111 is led to the port 142*d* of the two-position valve 142 via a throttle 140*a* and a position where the working fluid discharged by the variable displacement hydraulic pump 11 is led to the tank 112 based on the pressure of the working fluid supplied to the port 142*d* of the two-position valve 142 and a signal inputted via a signal wire 545*a*.

Additionally, a computer, not shown, of the electro-hydraulic actuation system 500 is configured to receive pressures detected by a pressure gauge 145, a pressure gauge 146, a pressure gauge 147, a pressure gauge 148 and a pressure gauge 149 for input thereinto, change the rotational speed of the electric motor 123 of the unit 520 and an electric motor 133 of the unit 530 at substantially the same ratio relative to the electric motor 123 and the electric motor 133 based on the pressures so inputted, produce a signal based on the inputted pressures and input the signal so produced into the two-position electromagnetic valve 514.

Furthermore, the computer, not shown, is configured to select a driving side pressure while following the motor rotating direction of the hydraulic motors 122 and 132 based on values of the pressures inputted from the pressure gauge 145, the pressure gauge 146, the pressure gauge 147 and the pressure gauge 148, select a greatest pressure of the pressures of the hydraulic motor 122 and the hydraulic motor 132 and input the pressure so selected into the pressure setting valve 545 as a signal via the signal wire 545*a*.

Here, the pressure gauge 145, the pressure gauge 146, the pressure gauge 147, the pressure gauge 148, the pressure gauge 149, the computer, not shown, the pressure setting valve 545, the two-position valve 142, a spring 143 and a discharge volume changing hydraulic cylinder 144 constitutes a discharge volume changing means for changing the working fluid discharge volume of the variable displacement hydraulic pump 111 based on the greatest pressure of the pressures of the working fluid supplied to the hydraulic motor 122 of the unit 520 and the hydraulic motor 132 of the unit 530 and the working fluid discharge pressure of the variable displacement hydraulic pump 111.

Next, the operation of the electro-hydraulic actuation system according to the embodiment will be described.

Note that the detailed description of those of operations of the electro-hydraulic actuation system 500 according to the embodiment will be omitted which are substantially similar to the operations of the electro-hydraulic actuation system 100 (refer to FIG. 1) according to the first embodiment.

The computer, not shown, selects a driving side pressure while following the motor rotating direction of the hydraulic motors 122 and 132 based on values of the pressures inputted from the pressure gauge 145, the pressure gauge 146, the pressure gauge 147 and the pressure gauge 148, selects a greatest pressure of the pressures of the hydraulic motor 122 and the hydraulic motor 132 and inputs the pressure so selected into the pressure setting valve 545 as a signal via the signal wire 545*a*.

When the signal is inputted thereinto by the computer, not shown, the pressure setting valve 545 produces a force in accordance with the signal so inputted and changes positions based on the force so produced and the pressure of the working fluid supplied to the port 142*d* of the two-position valve 142.

To be specific, when the force produced in accordance with the signal inputted is greater than a force produced by virtue of the pressure of the working fluid supplied to the port 142*d* of the two-position valve 142, the pressure setting valve 545 is switched to a position where the working fluid discharged by the variable displacement hydraulic pump 111 is led to the port 142*d* of the two-position valve 142 via the throttle 140*a* and when the force produced in accordance with the signal inputted is equal to or smaller than the force produced by virtue of the pressure of the working fluid supplied to the port 142*d* of the two-position valve 142, the pressure setting valve 545 is switched to a position where the working fluid discharged by the variable displacement hydraulic pump 111 is led to the tank 112.

Here, the pressure setting valve 545 is configured to produce a force which allows the computer, not shown, to implement a feedback using the pressure from the pressure gauge 149 so that the pressure of the working fluid supplied to the port 142*d* of the two-position valve 142 becomes a sum of the pressure selected from the hydraulic motor 122 of the unit 520 and the hydraulic motor 132 of the unit 530 and a pressure allowance that is determined in advance.

Consequently, the pressure of the working fluid supplied to the port 142*d* of the two-position valve 142 becomes substantially the same as the sum of the pressure selected from the hydraulic motor 122 of the unit 520 and the hydraulic motor 132 of the unit 530 and the pressure allowance that is determined in advance, and as has been described in the first embodiment, the electro-hydraulic actuation system 500 can change the working fluid discharge volume of the variable displacement hydraulic pump 111 so as to become the sum of the greater pressure of the pressures of the hydraulic motor 122 of the unit 520 and the hydraulic motor 132 of the unit 530 and the pressure allowance that is determined in advance.

In addition, as has been described in the first embodiment, when determining that there has occurred a shortage in volume of the working fluid supplied to either of the hydraulic motor 122 of the unit 520 and the hydraulic motor 132 of the unit 530 based on the pressures inputted from the pressure gauge 145, the pressure gauge 146, the pressure gauge 147, the pressure gauge 148 and the pressure gauge 149, the computer, not shown, generates a signal which locates the two-position electromagnetic valve 514 at the first position 514A and inputs the signal so generated into the two-position electromagnetic valve 545.

When the two-position electromagnetic valve 514 is located at the first position 514A in response to the signal inputted from the computer, not shown, since the set pressure of the relief valve 113 becomes largest within a designed range, the pressure of the working fluid discharged by the variable displacement hydraulic pump 111 for supply to the unit 520 and the unit 530 can be increased to a set pressure of the relief valve 113 which is greatest within the designed range.

In addition, as has been described in the first embodiment, when determining that there has occurred a shortage in volume of the working fluid supplied to either of the hydraulic motor 122 of the unit 520 and the hydraulic motor 132 of the unit 530 based on the pressures inputted from the pressure gauge 145, the pressure gauge 146, the pressure gauge 147, the pressure gauge 148 and the pressure gauge 149, the computer, not shown, reduces the rotational speed of the electric motor 123 and the electric motor 133 at the same or a predetermined ratio, thereby making it possible to prevent a state in which the volume of working fluid is short.

In addition, when determining that there is occurring no shortage in volume of the working fluid supplied to the hydraulic motor 122 of the unit 520 and the hydraulic motor 132 of the unit 530 based on the pressures inputted from the pressure gauge 145, the pressure gauge 146, the pressure gauge 147, the pressure gauge 148 and the pressure gauge 149, the computer, not shown, produces a signal which locates the two-position electromagnetic valve 514 at the second position 514B and inputs the signal so produced to the two-position electromagnetic valve 514.

When the two-position electromagnetic valve 514 is located at the second position 514B in response to the signal inputted from the computer, not shown, since the set pressure of the relief valve 113 becomes smallest within the designed range, the pressure of the working fluid discharged by the variable displacement hydraulic pump 111 for supply to the unit 520 and the unit 530 can only be increased to a set pressure of the relief valve 113 which is smallest within the designed range.

Consequently, when there is occurring no shortage in volume of the working fluid supplied to the hydraulic motor 122 of the unit 520 and the hydraulic motor 132 of the unit 530, the electro-hydraulic actuation system 500 can suppress the pressure of working fluid discharged by the variable displacement hydraulic pump 111 for supply to the unit 520 and the unit 530 to the set pressure of the relief valve 113 which is the smallest within the designed range or smaller and can reduce energy consumed by the variable displacement hydraulic pump 111 when compared with a case where the two-position electromagnetic valve 514 is provided. In addition, in a state where the rotational speed inputted is 0, the computer, not shown, outputs to the pressure setting valve 545 a signal which makes the discharge pressure of the variable displacement hydraulic pump 111 become a predetermined low pressure based on the pressure of the pressure gauge 149, thereby making it possible to reduce energy consumed. Additionally, in the state where the rotational speed inputted is 0, the computer, not shown, outputs to the pressure setting valve 545 a signal which makes the discharge pressure of the variable displacement hydraulic pump 111 become a predetermined low pressure based on the pressure of the pressure gauge 149, thereby making it possible to reduce energy consumed.

(Fourth Embodiment)

Firstly, the configuration of an electro-hydraulic actuation system according to a fourth embodiment will be described.

Figure 21:
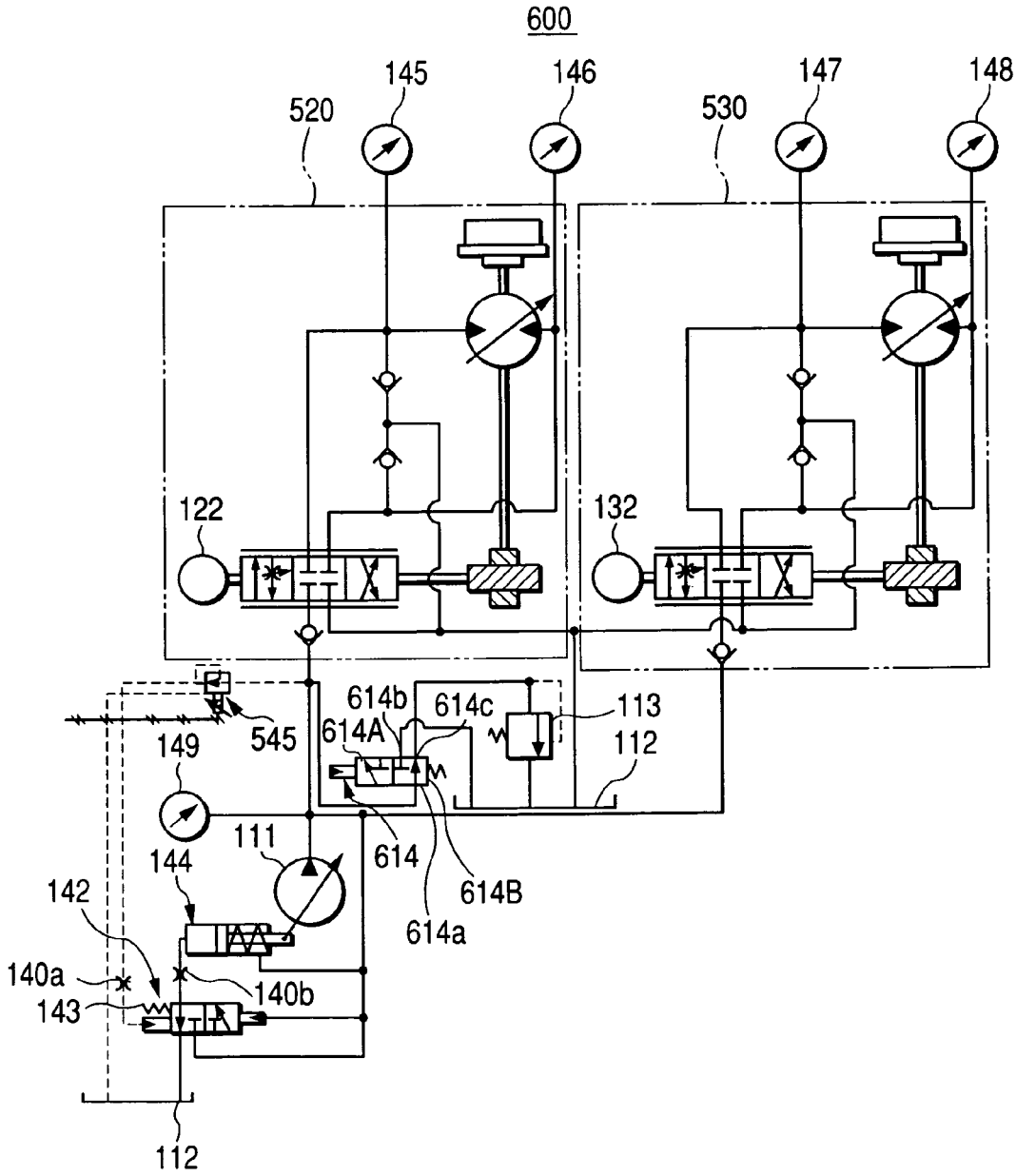
FIG. 21 is a hydraulic circuit diagram of an electro-hydraulic actuation system according to a fourth embodiment of the invention.

As shown in FIG. 21, since an electro-hydraulic actuation system 600 as an electro-hydraulic actuation system according to the embodiment has a substantially similar configuration to that of the electro-hydraulic actuation system 500 (refer to FIG. 15) according to the third embodiment, hereinafter, like reference numerals are imparted to constituent parts of the electro-hydraulic actuation system 600 which are substantially like to those of the electro-hydraulic actuation system 500.

The electro-hydraulic actuation system 600 includes, instead of the two-position electromagnetic valve 514 (refer to FIG. 15) of the electro-hydraulic actuation system 500 (refer to FIG. 15), a two-position electromagnetic valve 614 having formed therein a port 614*a* which communicates with a variable displacement hydraulic pump 111, a unit 520 and a unit 530, a port 614*b* which communicates with a tank 112 and a port 614*c* which communicates with a relief valve 113 and adapted to take based on a signal inputted either of a first position where the communication of the port 614*a* and the port 614*b* is established and a second position where the communication of the port 614*a* and the port 614*c* is established.

In addition, a computer, not shown, of the electro-hydraulic actuation system 600 is configured to receive pressures detected by a pressure gauge 145, a pressure gauge 146, a pressure gauge 147, a pressure gauge 148 and a pressure gauge 149 for input thereinto, produce a signal based on the pressures inputted and input the signal produced into the two-position electromagnetic valve 614.

Next, the operation of the electro-hydraulic actuation system 600 according to the invention will be described.

Note that the detailed description of those of operations of the electro-hydraulic actuation system 600 will be omitted which are substantially similar to the operations of the electro-hydraulic actuation system 500 (refer to FIG. 15) according to the third embodiment.

As has been described in the first embodiment, when determining that there has occurred a shortage in volume of the working fluid supplied to either of the hydraulic motor 122 of the unit 520 and the hydraulic motor 132 of the unit 530 based on the pressures inputted from the pressure gauge 145, the pressure gauge 146, the pressure gauge 147, the pressure gauge 148 and the pressure gauge 149, the computer, not shown, generates a signal which locates the two-position electromagnetic valve 614 at the second position 614B and inputs the signal so generated into the two-position electromagnetic valve 614.

When the two-position electromagnetic valve 614 takes the second position 614B in response to the signal inputted from the computer, not shown, since the port 614*a* which communicates with the variable displacement hydraulic pump 111, the unit 520 and the unit 530 communicates with the port 614*c* which communicates with the relief valve 113, the pressure of a working fluid discharged by the variable displacement hydraulic pump 111 for supply to the unit 520 and the unit 530 can be increased to a set pressure for the relief valve 113.

In addition, when determining that there is occurring no shortage in volume of the working fluid supplied to the hydraulic motor 122 of the unit 520 and the hydraulic motor 132 of the unit 530 based on the pressures inputted from the pressure gauge 145, the pressure gauge 146, the pressure gauge 147, the pressure gauge 148 and the pressure gauge 149, the computer, not shown, generates a signal which locates the two-position electromagnetic valve 614 at the first position 614A and inputs the signal so generated into the two-position electromagnetic valve 614.

When the two-position electromagnetic valve 614 takes the first position 614A in response to the signal inputted from the computer, not shown, since the port 614*a* which communicates with the variable displacement hydraulic pump 111, the unit 520 and the unit 530 communicates with the port 614*b* which communicates with the tank 112, the pressure of the working fluid discharged by the variable displacement hydraulic pump 111 for supply to the unit 520 and the unit 530 is reduced when compared to the case where the two-position electromagnetic valve 614 takes the second position 614B.

Consequently, the electro-hydraulic actuator system 600 can suppress the pressure of the working fluid discharged by the variable displacement hydraulic pump 111 for supply to the unit 520 and the unit 530 when there is occurring no shortage in volume of the working fluid supplied to the hydraulic motor 122 of the unit 520 and the hydraulic motor 132 of the unit 530 to a smaller value when compared with when there is occurring a shortage in volume of the working fluid supplied to the hydraulic motor 122 of the unit 520 and the hydraulic motor 132 of the unit 530 and can reduce energy consumed by the variable displacement hydraulic pump 111 when compared with a case where the two-position electromagnetic valve 614 is not provided.

The invention claimed is:

1. An electro-hydraulic actuation system being characterized by comprising a pump, a plurality of electro-hydraulic actuators each having an electric motor, a hydraulic actuator and a fluid volume changing valve for changing the volume of a fluid discharged by the pump based on driving amounts of the electric motor and the hydraulic actuator for supply to the hydraulic actuator, discharge volume changing means for changing the volume of the fluid discharged by the pump based on a maximum pressure of pressures of the fluid supplied to the hydraulic actuators of the plurality of electro-hydraulic actuators and the discharge pressure of the fluid discharged by the pump, and rotational speed changing means for changing the rotational speed of the electric motors of the plurality of electro-hydraulic actuators at substantially the same ratio relative to the electric motors of the plurality of electro-hydraulic actuators based on a maximum pressure of pressures of the fluid supplied to the hydraulic actuators of the plurality of electro-hydraulic actuators and the discharge pressure of the fluid discharged by the pump.

* * * * *